US011509047B2

(12) United States Patent
Chiang

(10) Patent No.: US 11,509,047 B2
(45) Date of Patent: Nov. 22, 2022

(54) SERIES-CONNECTED ANTENNA STRUCTURE

(71) Applicant: AUDEN TECHNO CORP., Taoyuan (TW)

(72) Inventor: Chi-Ming Chiang, Taoyuan (TW)

(73) Assignee: AUDEN TECHNO CORP., Taoyuan (TW)

( * ) Notice: Subject to any disclaimer, the term of this patent is extended or adjusted under 35 U.S.C. 154(b) by 0 days.

(21) Appl. No.: 17/243,726

(22) Filed: Apr. 29, 2021

(65) Prior Publication Data

US 2022/0209399 A1 Jun. 30, 2022

(30) Foreign Application Priority Data

Dec. 30, 2020 (TW) ..... 109217340

(51) Int. Cl.

| | |
|---|---|
| ***H01Q 1/38*** | (2006.01) |
| ***H01Q 21/00*** | (2006.01) |
| ***H01Q 9/04*** | (2006.01) |
| ***H01Q 21/26*** | (2006.01) |

(52) U.S. Cl.

CPC ..... *H01Q 1/38* (2013.01); *H01Q 9/045* (2013.01); *H01Q 21/0006* (2013.01); *H01Q 21/26* (2013.01)

(58) Field of Classification Search

CPC ..... H01Q 1/38; H01Q 9/045; H01Q 21/0006; H01Q 21/26

See application file for complete search history.

(56) References Cited

U.S. PATENT DOCUMENTS

2002/0190912 A1* 12/2002 Lebaric ..... H01Q 9/28 343/816
2004/0183727 A1* 9/2004 Choi ..... H01Q 21/08 343/702
2010/0060526 A1* 3/2010 Cheng ..... H01Q 1/38 343/700 MS

* cited by examiner

*Primary Examiner* — David E Lotter
(74) *Attorney, Agent, or Firm* — Li & Cai Intellectual Property (USA) Office

(57) ABSTRACT

A series-connected antenna structure is provided. The series-connected antenna structure includes an insulating substrate, a first connecting line, two first antennas, a second connecting line, two second antennas, and a load point. Two sub-antennas of one of the two first antennas are electrically coupled to a main section of the first connecting line, and two sub-antennas of another one of the two first antennas are respectively and electrically coupled to two subordinate sections of the first connecting line. Two sub-antennas of one of the two second antennas are electrically coupled to a main section of the second connecting line, and two sub-antennas of another one of the two second antennas are respectively and electrically coupled to two subordinate sections of the second connecting line. Each of the two second antennas and each of the two first antennas face opposite directions.

10 Claims, 27 Drawing Sheets

SERIES-CONNECTED ANTENNA STRUCTURE

CROSS-REFERENCE TO RELATED PATENT APPLICATION

This application claims the benefit of priority to Taiwan Patent Application No. 109217340, filed on Dec. 30, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and more particularly to a series-connected antenna structure.

BACKGROUND OF THE DISCLOSURE

In order for conventional antenna structures to have omnidirectional radiation and high gain, most of the conventional antenna structures are implemented by using dipole antennas for serial connection. Specifically, for the conventional antenna structures, a connecting line is used to connect antennas in series in the making of a circuit board. However, if the conventional antenna structures only have the antennas connected in series on one of two sides of the circuit board, a radiation pattern of the conventional antenna structures cannot meet the omnidirectional requirement due to an influence from the ground. Therefore, in most of the conventional antenna structures, the antennas are symmetrically arranged on two sides of the circuit board. However, after two radiation patterns on the both sides of the circuit board of the conventional antenna structures influence each other, a difference between the radiation patterns on the either side of the circuit board will be too large to approach a circular shape (that is, the degree of roundness is too low).

SUMMARY OF THE DISCLOSURE

In response to the above-referenced technical inadequacies, the present disclosure provides a series-connected antenna structure to effectively improve the issues associated with the conventional antenna structures.

In one aspect, the present disclosure provides a series-connected antenna structure. The series-connected antenna structure includes an insulating substrate, a first connecting line, two first antennas, a second connecting line, two second antennas, and a load point. The insulating substrate includes a first surface and a second surface. The first connecting line is disposed on the first surface and includes a first main section and two first subordinate sections that are connected to the first main section. The first main section is arranged on one of two sides of the first surface, and the two first subordinate sections are arranged on another one of the two sides of the first surface. The two first antennas are disposed on the first surface and are spaced apart from each other. Each of the two first antennas has two first sub-antennas each having one of a plurality of first free ends and one of a plurality of first connection ends that are opposite to each other. The two first sub-antennas of one of the two first antennas are electrically coupled to the first main section by the first connection ends thereof, and jointly form a symmetrical shape. The two first sub-antennas of another one of the two first antennas are respectively and electrically coupled to the two first subordinate sections by the first connection ends thereof, and jointly form a symmetrical shape. The second connecting line is disposed on the second surface and includes a second main section and two second subordinate sections that are connected to second main section. The second main section is arranged on one of two sides of the second surface, and the two second subordinate sections are arranged on another one of the two sides of the second surface. The two second antennas are disposed on the second surface and are spaced apart from each other. The two second antennas correspond in position to the two first antennas. Each of the two second antennas has two second sub-antennas each having one of a plurality of second free ends and one of a plurality of second connection ends that are opposite to each other. The two second sub-antennas of one of the two second antennas are electrically coupled to the second main section by the second connection ends thereof, and jointly form a symmetrical shape. The two second sub-antennas of another one of the two second antennas are respectively and electrically coupled to the two second subordinate sections by the second connection ends thereof, and jointly form a symmetrical shape. In one of the two second antennas and one of the two first antennas that correspond in position to each other, two of the second free ends of the second antenna and two of the first free ends of the first antenna face opposite directions. The load point is disposed on the insulating substrate and is electrically coupled to the first connecting line and the second connecting line.

Therefore, by virtue of "in one of the two first antennas and one of the two second antennas that correspond in position to each other, the connection end of the two first sub-antennas being electrically coupled to the main section of the first connecting line, and the connection end of the two second sub-antennas being electrically coupled to the main section of the second connecting line" and "in one of the two first antennas and one of the two second antennas that correspond in position to each other, the connection end of the two first sub-antennas being respectively and electrically coupled to the two subordinate sections of the first connecting line, and the connection end of the two second sub-antennas being respectively and electrically coupled to the two subordinate sections of second connecting line", the series-connected antenna structure can improve the degree of roundness.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
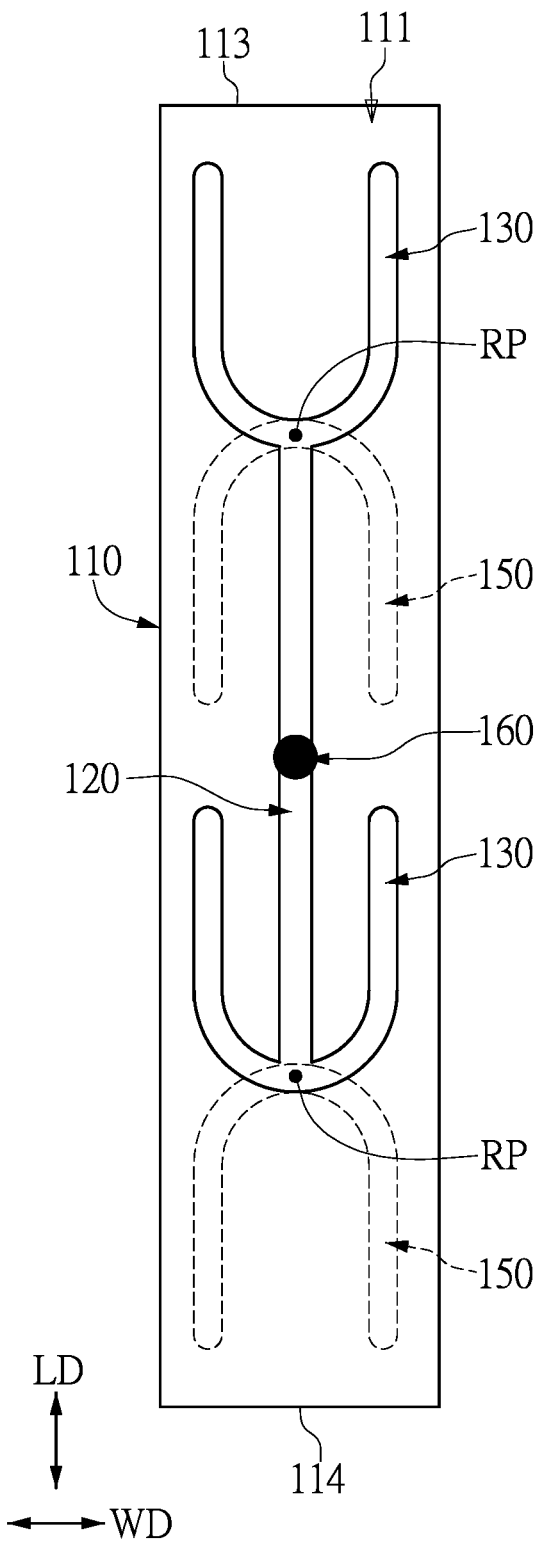
FIG. 1 is a schematic top view of a series-connected antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
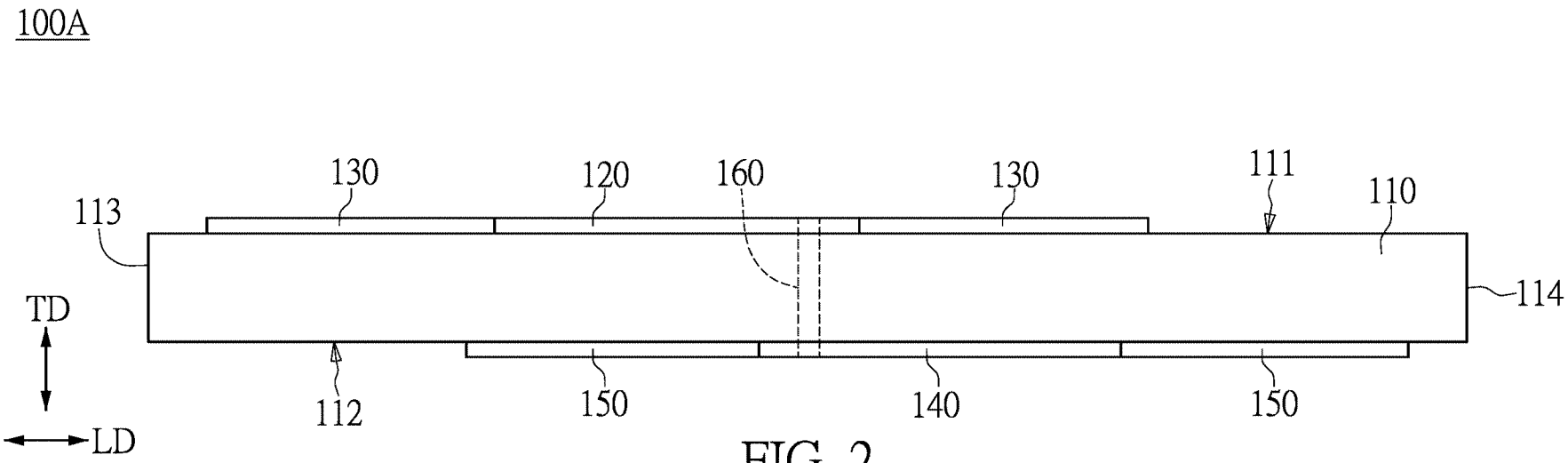
FIG. 2 is a schematic side view of the series-connected antenna structure according to the first embodiment of the present disclosure.

Referring to FIG. 1 to FIG. 4, a first embodiment of the present disclosure provides a series-connected antenna structure 100A that is suitable for a transmission frequency band. Referring to FIG. 1 and FIG. 2, the series-connected antenna structure 100A in the present embodiment includes an insulating substrate 110, a first connecting line 120 and two first antennas 130 disposed on one of two sides of the insulating substrate 110, a second connecting line 140 and two second antennas 150 disposed on another one of the two sides of the insulating substrate 110, and a load point 160 that is electrically coupled to the first connecting line 120 and the second connecting line 140. Next, the following description describes the structure and connection relation of each component of the series-connected antenna structure 100A.

Referring to FIG. 1 and FIG. 2, the insulating substrate 110 is in an elongated shape, and has a length direction LD and a width direction WD that is perpendicular to the length direction LD. The insulating substrate 110 is, for example, in the shape of a rectangle in the present embodiment. However, an appearance of the insulating substrate 110 is not limited to a rectangle, and the appearance and size of the insulating substrate 110 can be changed according to requirements. Moreover, a long side of the rectangle is parallel to the length direction LD, and a short side of the rectangle is parallel to the width direction WD.

In the present embodiment, the insulating substrate 110 includes a first surface 111 and a second surface 112 that are opposite to each other, and two ends of the insulating substrate 110 along the length direction LD are respectively defined as a first end 113 and a second 114. For the convenience of description, the first surface 111 faces an upward direction in FIG. 2, and the second surface 112 faces a downward direction in FIG. 2. The first end 113 is located on a left side of the insulating substrate 110 in FIG. 2, and the second end 114 is located on a right side of the insulating substrate 110 in FIG. 2.

Figure 3:
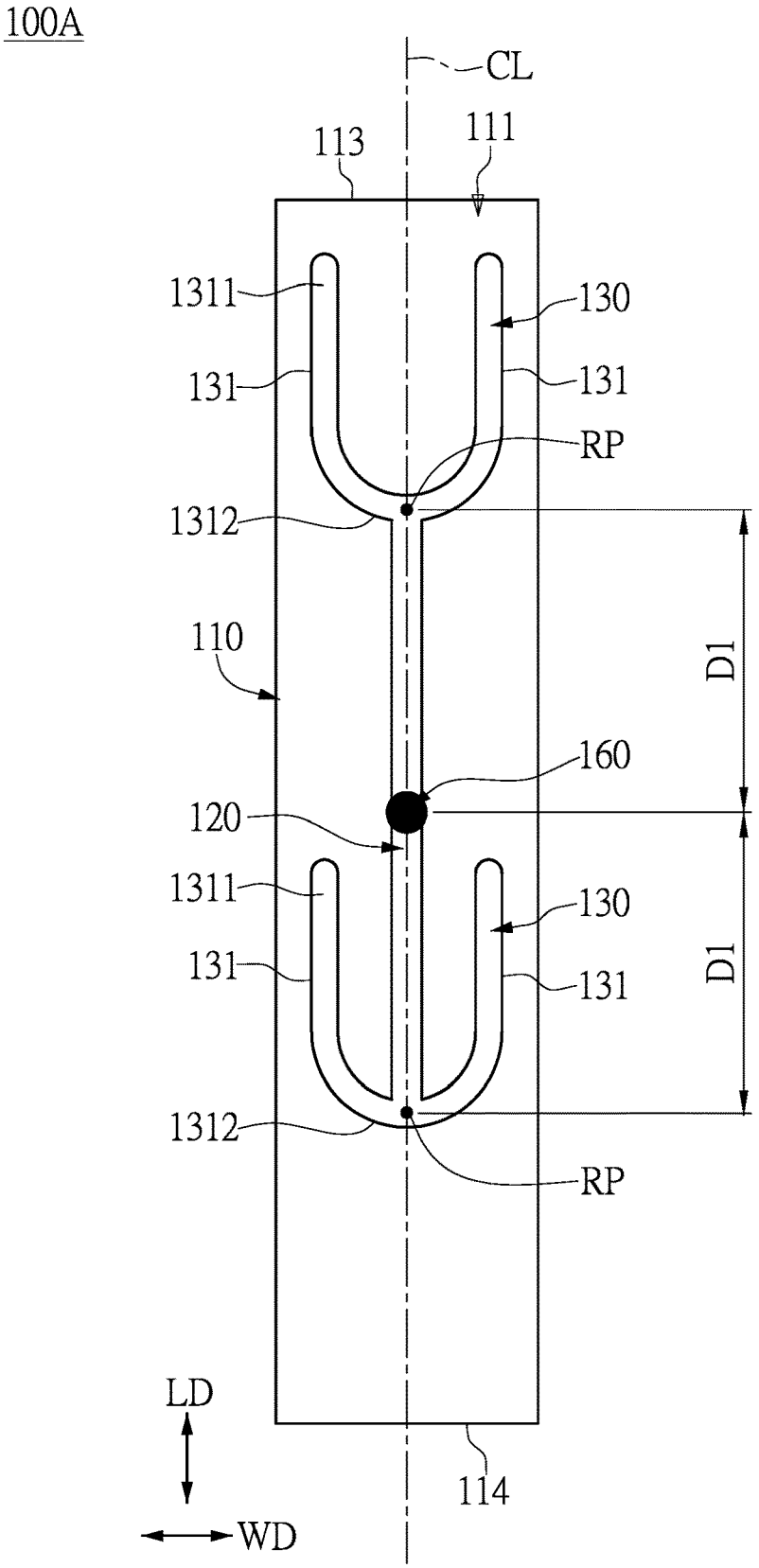
FIG. 3 is a schematic top view of facing a first surface of the series-connected antenna structure according to the first embodiment of the present disclosure.
Figure 4:
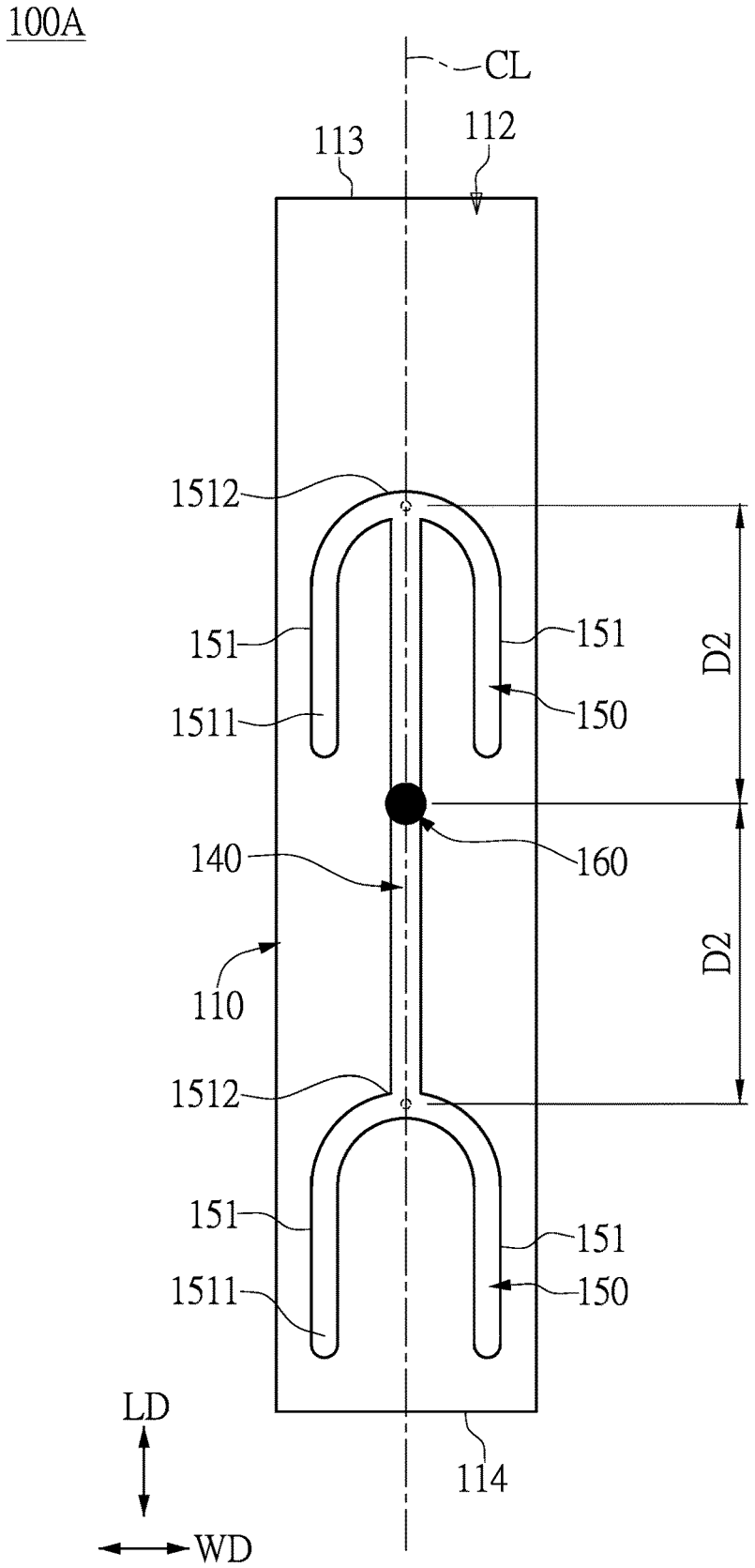
FIG. 4 is a schematic top view of facing a second surface of the series-connected antenna structure according to the first embodiment of the present disclosure.

In addition, referring to FIG. 3 and FIG. 4, the first surface 111 and the second surface 112 each have a center line CL along the length direction LD. In other words, the first surface 111 has one center line CL, the second surface 112 also has one center line CL, and a region defined by orthogonally projecting the center line CL of the first surface 111 toward the second surface 112 is overlapped with the center line CL of the second surface 112.

The first connecting line 120 in the present embodiment is disposed on the first surface 111, and is arranged roughly along the center line CL of the first surface 111, but the present disclosure is not limited thereto. For example, in another embodiment of the present disclosure that is not shown, the first connecting line 120 may be arranged along an imaginary line that extends along the length direction LD and located at any positions on the first surface 111.

Referring to FIG. 3, the two first antennas 130 are disposed on the first surface 111 and are spaced apart from each other. In the present embodiment, each of the two first antennas 130 has two first sub-antennas 131 each having one of a plurality of first free ends 1311 and one of a plurality of first connection ends 1312 that are opposite to each other. The two first sub-antennas 131 of each of the two first antennas 130 are electrically coupled to the first connecting line 120 by the first connection ends 1312 thereof and jointly form a symmetrical shape.

Specifically, each of the two first antennas 130 in the present embodiment is substantially in a U-shape, and the center line CL of the first surface 111 is a line of symmetry that is common to the two first antennas 130. The two first sub-antennas 131 of each of the two first antennas 130 are respectively located on two sides of the line of symmetry (i.e., the center line CL of the first surface 111), and two of the first free ends 1311 of each of the two first sub-antennas 131 face the first end 113.

It should be noted that the two first antennas 130 and the first connecting line 120 in the present embodiment are integrally connected to each other, but the present disclosure is not limited thereto. For example, the two first antennas 130 and the first connecting line 120 may each be a single member, and are electrically coupled to each other.

Next, referring to FIG. 4, the second connecting line 140 in the present embodiment is disposed on the second surface 112, and is arranged roughly along the center line CL of the second surface 112, but the present disclosure is not limited thereto. For example, in another embodiment of the present disclosure that is not shown, the second connecting line 140 may be arranged along an imaginary line that extends along the length direction LD and located at any positions on the second surface 112. It should be noted that, in practice, a region defined by orthogonally projecting the second connecting line 140 toward the first surface 111 needs to be overlapped with the first connecting line 120 (as shown in FIG. 1).

The two second antennas 150 are disposed on the second surface 112 and are spaced apart from each other. The two second antennas 150 roughly correspond in position to the two first antennas 130. In the present embodiment, each of the two second antennas 150 has two second sub-antennas 151 each having one of a plurality of second free ends 1511 and one of a plurality of second connection ends 1512 that are opposite to each other. The two second sub-antennas 151 of each of the two second antennas 150 are electrically coupled to the second connecting line 140 by the second connection ends 1512 thereof and jointly form a symmetrical shape.

In the present embodiment, the shape of each of the two second antennas 150 is the same as the shape of each of the two first antennas 130. That is, the two second antennas 150 are each substantially in a U-shape, and the center line CL of the second surface 112 is a line of symmetry that is common to the two second antennas 150. The two second sub-antennas 151 of each of the two second antennas 150 are respectively located on two sides of the line of symmetry (i.e., the center line CL of the second surface 112), and a direction toward which two of the second free ends 1511 of the two second antennas 150 face is opposite to a direction toward which two of the first free ends 1311 of the two first antennas 130 face. In other words, the two second free ends 1511 of each of the two second sub-antennas 151 face the second end 114.

It should be noted that the two second antennas 150 and the second connecting line 140 in the present embodiment are integrally connected to each other, but the present disclosure is not limited thereto. For example, the two second antennas 150 and the second connecting line 140 may each be a single member, and are electrically coupled to each other.

In addition, although the two first antennas 130 and the two second antennas 150 in the present embodiment are each in the U-shape, the two first antennas 130 and the two second antennas 150 in another embodiment of the present disclosure that is not shown may also be in other symmetrical shapes, such as a "-" shape, or an "H" shape.

Referring to FIG. 1 and FIG. 3, the insulating substrate 110 has a reference position RP located at an electrical coupling point between any one of the two first antennas 130 and the first connecting line 120. That is to say, the insulating substrate 110 has two reference positions RP on the first connecting line 120. A region defined by orthogonally projecting any one of the two second antennas 150 toward the first surface 111 and one of the two first antennas 130 that corresponds in position to the any one of the two second antennas 150 jointly have a two-fold rotational symmetry relative to a corresponding one of the two reference positions RP.

Referring to FIG. 2 to FIG. 4, the load point 160 is electrically coupled to a part of the first connecting line 120 between the two reference positions RP and a part of the second connecting line 140 between two positions defined by orthogonally projecting the two reference positions RP toward the second surface 112.

The load point 160 in the present embodiment penetrates the insulating substrate 110 along a thickness direction TD of the insulating substrate 110, and two end surfaces of the load point 160 are respectively exposed from outer sides of the first surface 111 and the second surface 112, so as to be electrically coupled to the first connecting line 120 and the second connecting line 140. In other words, a region defined by orthogonally projecting one of the two end surfaces of the load point 160 located on the first surface 111 toward the second surface 112 is overlapped with another one of the two end surfaces of the load point 160 located on the second surface 112.

It is worth noting that a ratio of a distance between the load point 160 and one of the two reference positions RP to a distance between the load point 160 and another one of the two reference positions RP is 1:1. In other words, two first shortest distances D1 each being between one of the two end surfaces of the load point 160 located on the first surface 111 and any one of the two first antennas 130 are equal to each other, two second shortest distances D2 each being between another one of the two end surfaces of the load point 160 located on the second surface 112 and any one of the two second antennas 150 are also equal to each other, and any one of the two first shortest distances D1 is equal to any one of the two second shortest distances D2.

Furthermore, in practice, a total length of the two first shortest distances D1 or the two second shortest distances D2 is 0.5 to 1.5 times a wavelength corresponding to a center frequency of the transmission frequency band, which can also be understood as a distance between the two reference positions RP being 0.5 to 1.5 times the wavelength corresponding to the center frequency of the transmission frequency band. The distance is preferably equal to the wavelength corresponding to the center frequency of the transmission frequency band, but the present disclosure is not limited thereto. Through the above structure, the series-connected antenna structure 100A allows enables maximum values of a high frequency and a low frequency of a radiation pattern to be located on a horizontal plane after the two first antennas 130 disposed on the first board 111 and the two second antennas 150 disposed on the second board 112 influence each other.

In other words, any antenna structure that does not have a design of "the two end surfaces of the load point being respectively and electrically coupled to a part of a connecting line between two antennas disposed on one of two sides of the insulating substrate and to a part of a connecting line between two antennas disposed on another one of the two sides of the insulating substrate" is not the series-connected antenna structure 100A provided by the present disclosure.

Second Embodiment

Figure 5:
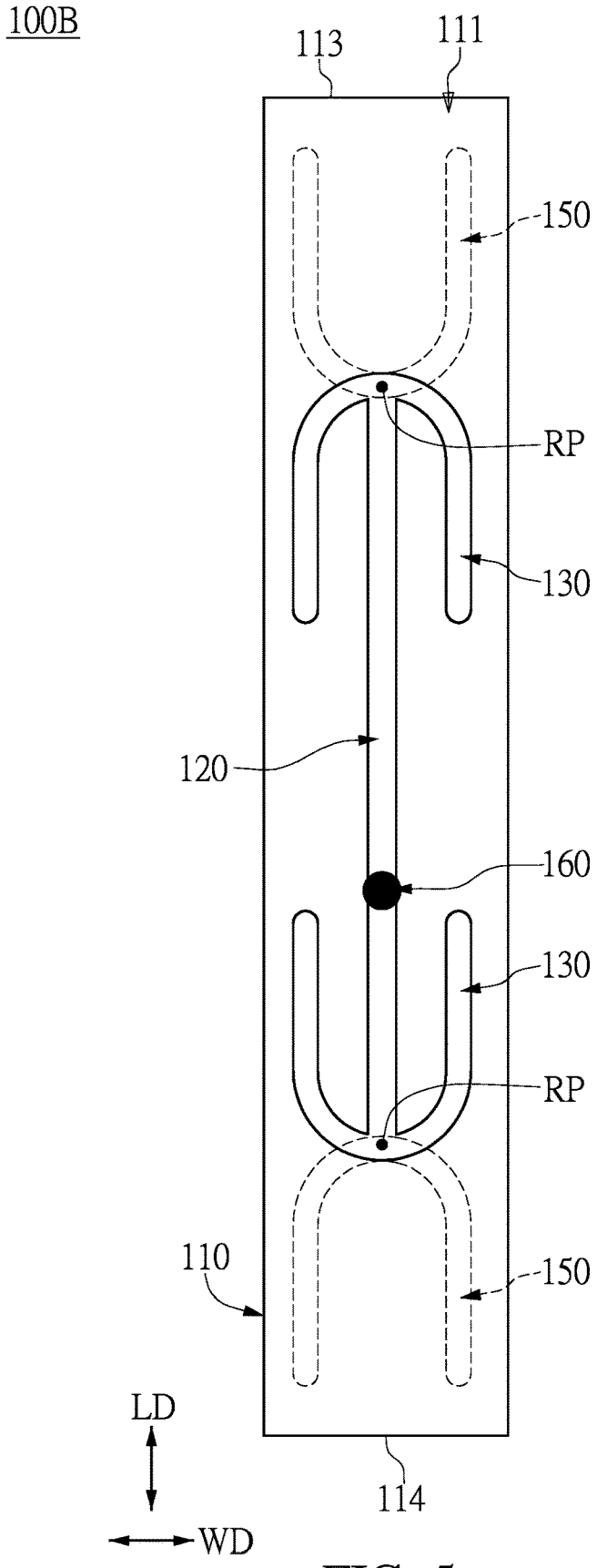
FIG. 5 is a schematic top view of the series-connected antenna structure according to a second embodiment of the present disclosure.
Figure 6:
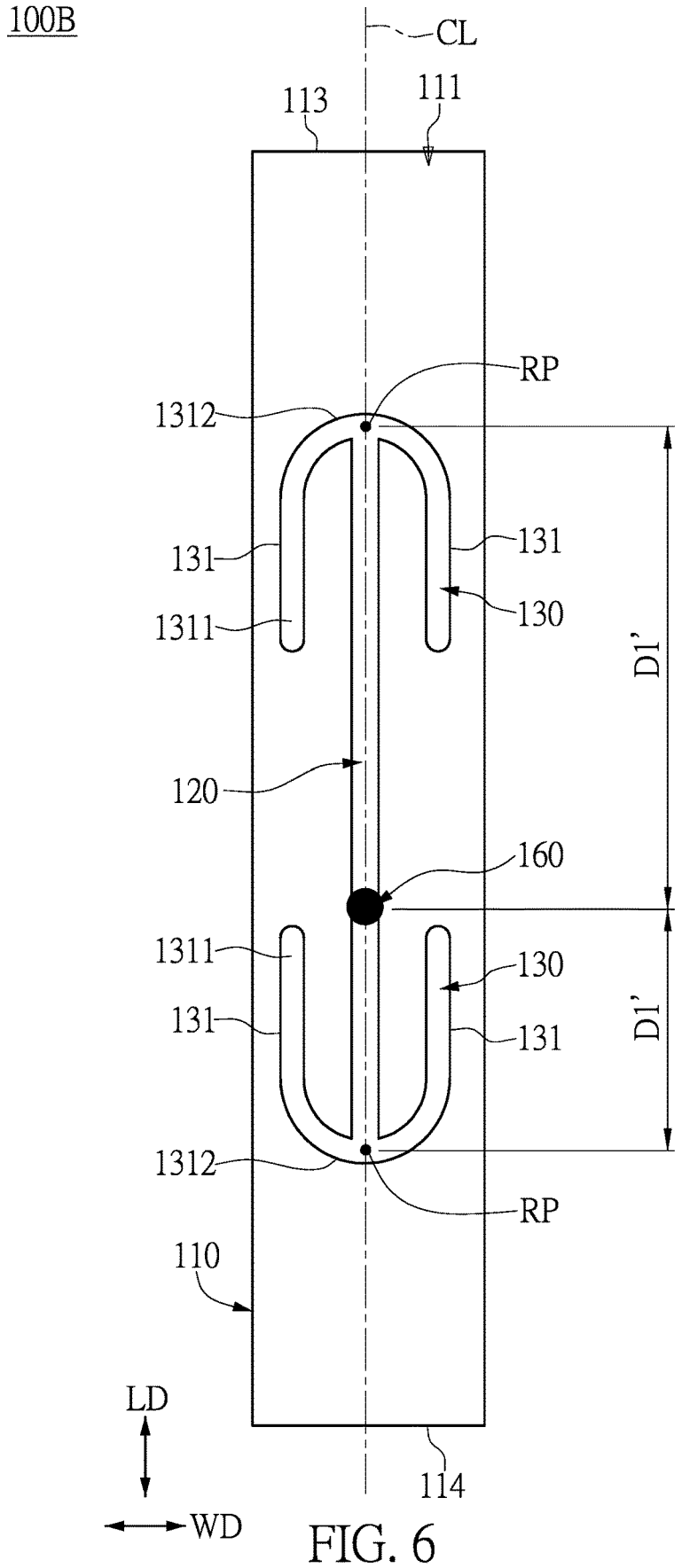
FIG. 6 is a schematic top view of facing the first surface of the series-connected antenna structure according to the second embodiment of the present disclosure.
Figure 7:
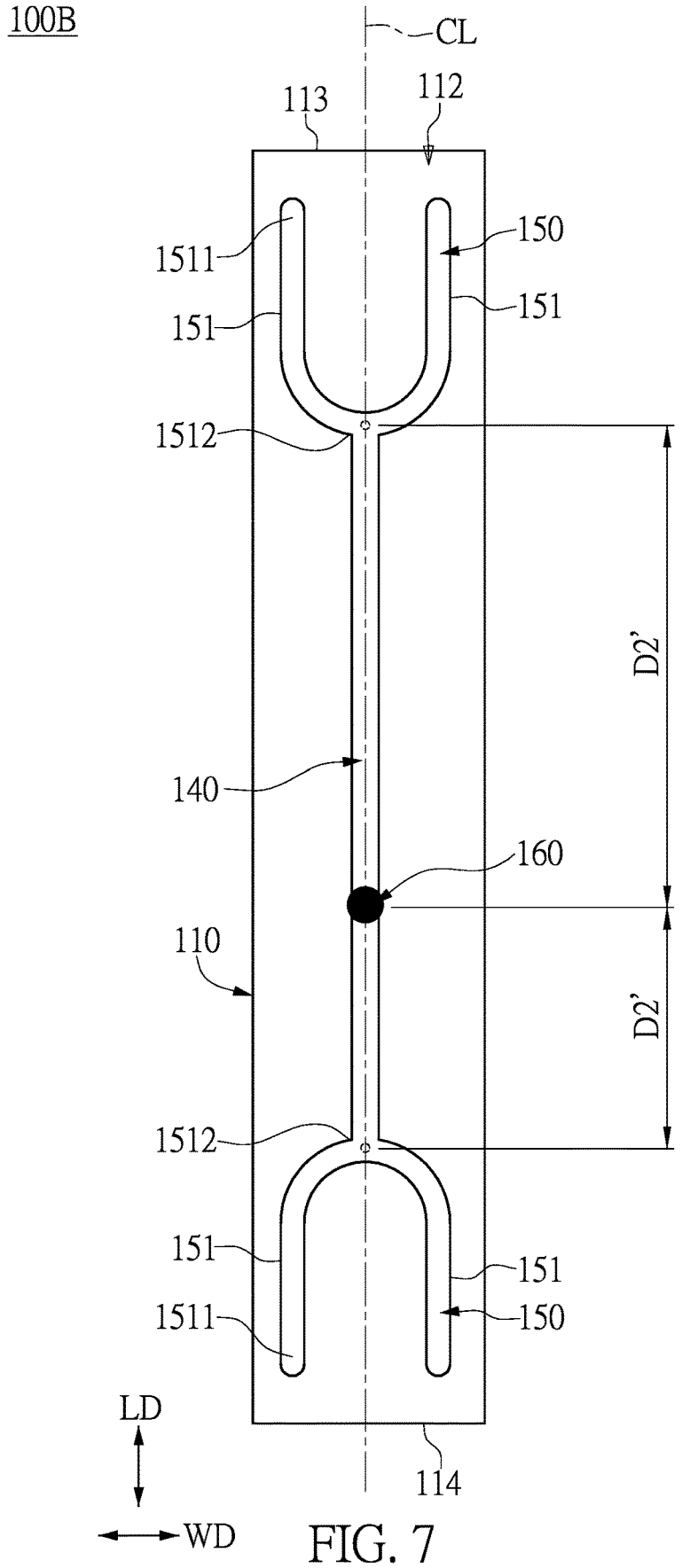
FIG. 7 is a schematic top view of facing the second surface of the series-connected antenna structure according to the second embodiment of the present disclosure.

Referring to FIG. 5 to FIG. 7, a second embodiment of the present disclosure provides a series-connected antenna structure 100B that is similar to the series-connected antenna structure 100A of the first embodiment, and the similarities therebetween will not be repeated herein. The difference between the present embodiment and the first embodiment mainly lies in that the two first antennas 130 do not face the same direction, and the two second antennas 150 do not face the same direction.

Specifically, in one of the two first antennas 130 (i.e., the first antenna 130 located at a lower position of FIG. 6) and one of the two second antennas 150 that corresponds in position thereto (i.e., the second antenna 150 located at a lower position of FIG. 7), the two first free ends 1311 of the first antenna 130 face the first end 113 and the two second free ends 1511 of the second antenna 150 face the second end 114. Moreover, in another one of the two first antennas 130 (i.e., the first antenna 130 located at an upper position of FIG. 6) and one of the two second antennas 150 that corresponds to the position thereto (i.e., the second antenna 150 located at an upper position of FIG. 7), the two first free ends 1311 of the first antenna 130 face the second end 114 and the two second free ends 1511 of the second antenna 150 face the first end 113. In other words, the two first antennas 130 in the present embodiment face each other (as shown in FIG. 6), the two second antennas 150 in the present embodiment face away from each other (as shown in FIG. 7), and a region defined by orthogonally projecting any one of the two second antennas 150 toward the first surface 111 and one of the two first antennas 130 that corresponds in position to the any one of the two second antennas 150 still jointly have a two-fold rotational symmetry relative to a corresponding one of the two reference positions RP.

It should be noted that, based on the direction change of the two first antennas 130 and the two second antennas 150 in the present embodiment, the position of the load point 160 needs to be further adjusted so that a ratio of a distance between the load point 160 and one of the two reference positions RP to a distance between the load point 160 and another one of the two reference positions RP is 1:3. In detail, referring to FIG. 6 and FIG. 7, a ratio of a first shortest distance D1' between one of the two end surfaces of the load point 160 located on the first surface 111 and one of the two first antennas 130 to a first shortest distance D1' between one of the two end surfaces of the load point 160 located on the first surface 111 and another one of the two first antennas 130 is 1:3, and a ratio of a second shortest distance D2' between another one of the two end surfaces of the load point 160 located on the second surface 112 and one of the two second antennas 150 to a second shortest distance D2' between another one of the two end surfaces of the load point 160 located on the second surface 112 and another one of the two second antennas 150 is 1:3. Accordingly, through the above structure, the series-connected antenna structure 100B (like the series-connected antenna structure 100A of the first embodiment) may allow the maximum values of the high frequency and the low frequency of the radiation pattern to be located on the horizontal plane.

Third Embodiment

Figure 8:
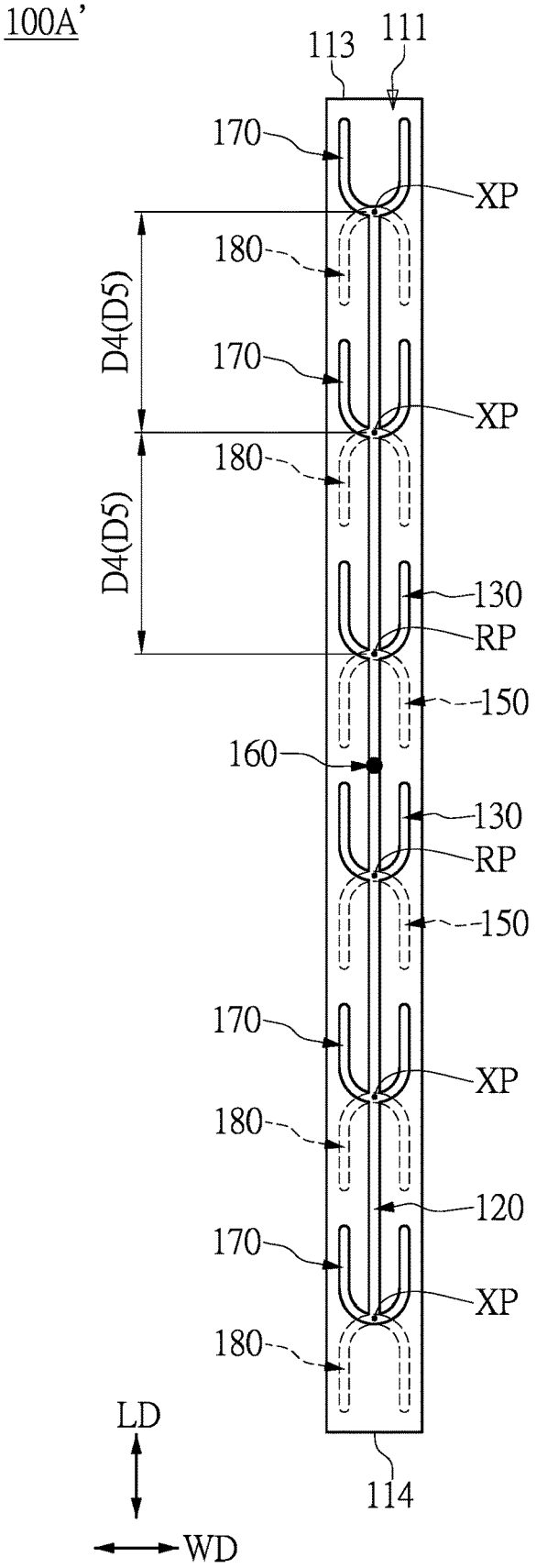
FIG. 8 is a schematic top view of the series-connected antenna structure according to a third embodiment of the present disclosure.
Figure 9:
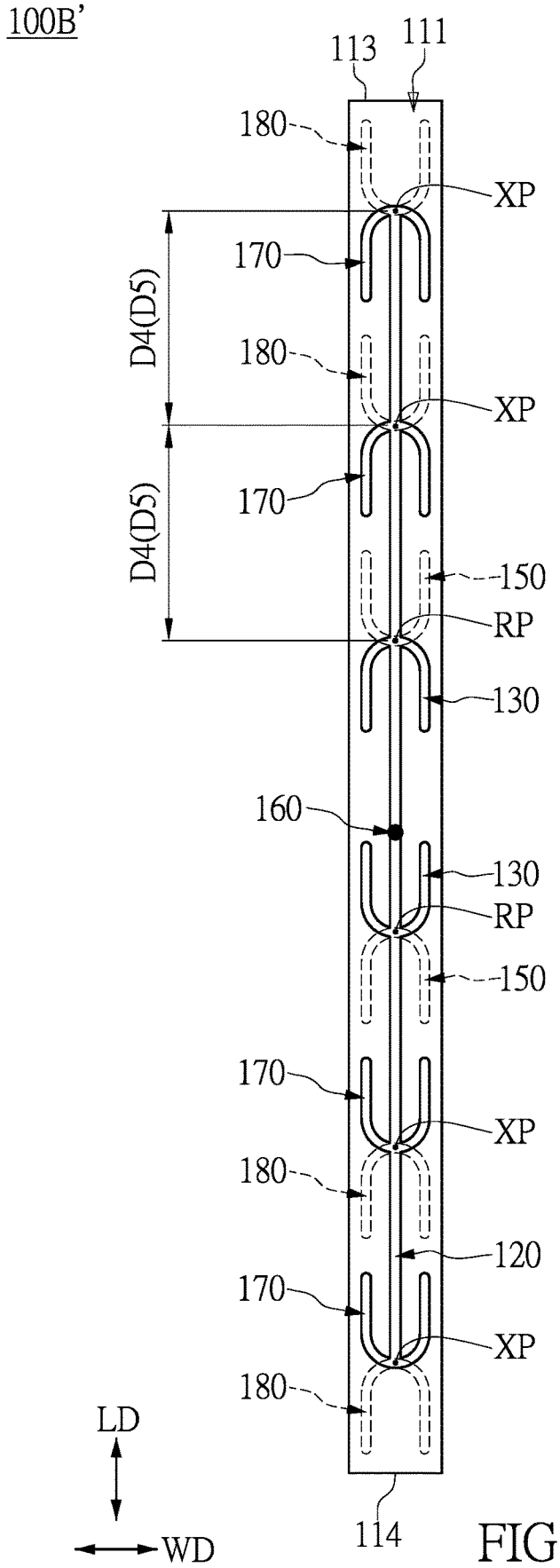
FIG. 9 is a schematic top view of another configuration of the series-connected antenna structure according to the third embodiment of the present disclosure.

Referring to FIG. 8 and FIG. 9, a third embodiment of the present disclosure provides series-connected antenna structures 100A', 100B' that are similar to the series-connected antenna structures 100A, 100B of the first embodiment and the second embodiment, and the similarities therebetween will not be repeated herein. The difference between the series-connected antenna structures 100A', 100B'of the present embodiment and those of the series-connected antenna structures 100A, 100B is described as below:

In the present embodiment, each of the series-connected antenna structures 100*a*', 100B' further includes a plurality of first auxiliary antennas 170 and a plurality of second auxiliary antennas 180. Each of the first auxiliary antennas 170 is equivalent to the first antenna 130, and each of the second auxiliary antennas 180 is equivalent to the second antenna 150.

Specifically, the first auxiliary antennas 170 in the present embodiment are equally disposed on the first surface 111, and are electrically coupled to the first connecting line 120. A shape of each of the first auxiliary antennas 170 is the same as a shape of the first antenna 130. The second auxiliary antennas 180 in the present embodiment are equally disposed on the second surface 112, and are electrically coupled to the second connecting line 140. A shape of each of the second auxiliary antennas 180 is the same as a shape of the second antenna 150, and a quantity of the second auxiliary antennas 180 is equal to a quantity of the first auxiliary antennas 170.

In addition, the insulating substrate 110 has one of a plurality of auxiliary reference positions XP located at an electrical coupling point between any one of the first auxiliary antennas 170 and the first connecting line 120. A region defined by orthogonally projecting any one of the second auxiliary antennas 180 toward the first surface 111 and one of the first auxiliary antennas 170 that corresponds in position to the any one of the second auxiliary antennas 180 jointly have a two-fold rotational symmetry relative to a corresponding one of the auxiliary reference positions XP.

It can be seen that, in terms of arrangement direction and arrangement method, each of the first auxiliary antennas 170 is disposed on the insulating substrate 110 in a manner substantially the same as that of the first antenna 130, and a setting direction and a setting method of each of the second auxiliary antennas 180 is disposed on the insulating substrate 110 in a manner substantially the same as that of the second antenna 150.

It should be noted that a distance between any two of the first auxiliary antennas 170 adjacent to each other and a distance between any one of the two first antennas 130 and an adjacent one of the first auxiliary antennas 170 each are defined as a first shortest distance D4, and the first shortest distances D4 are equal to each other. A distance between any two of the second auxiliary antennas 180 adjacent to each other and a distance between any one of the two second antennas 150 and an adjacent one of the second auxiliary antennas 180 each are defined as a second shortest distance D5, and the second shortest distances D5 are equal to each other. In practice, each of the first shortest distances D4 and each of the second shortest distances D5 are equal to the wavelength corresponding to the center frequency of the transmission frequency band.

In addition, referring to FIG. 8 and FIG. 9, although the quantity of the first auxiliary antennas 170 and the quantity of the second auxiliary antennas 180 are each an even number (e.g., four), and the first auxiliary antennas 170 and the second auxiliary antennas 180 are equally disposed on the first surface 111 and the second surface 112, the present disclosure is not limited thereto. For example, the quantity of the first auxiliary antennas 170 and the quantity of the second auxiliary antennas 180 may also each be an odd number (e.g., three), and the first auxiliary antennas 170 and the second auxiliary antennas 180 may be unequally disposed on the first surface 111 and the second surface 112.

Compared with the first embodiment and the second embodiment, the series-connected antenna structures 100A', 100B' of the present embodiment can increase an intensity of the radiation pattern according to user requirements.

Figure 10:
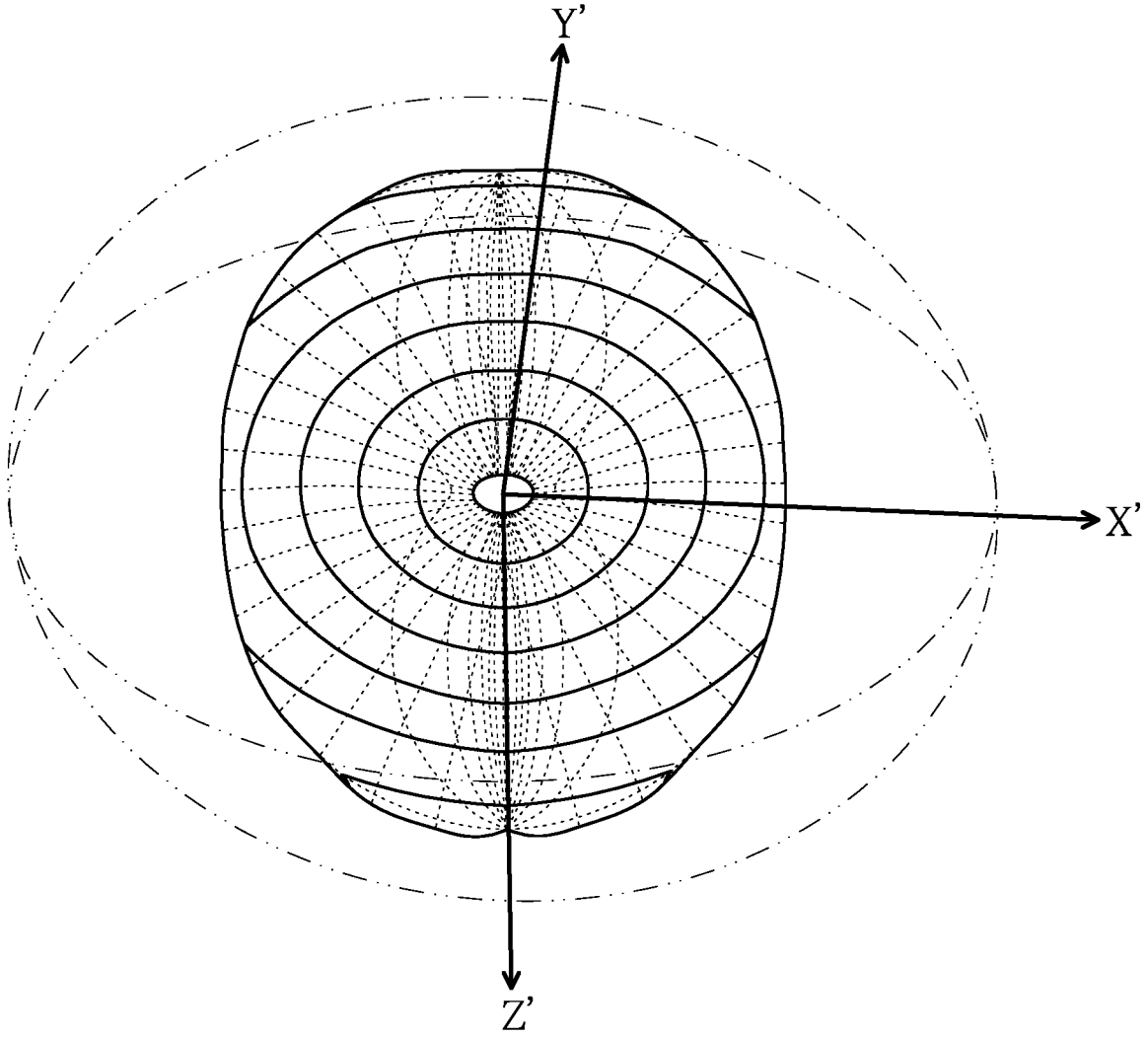
FIG. 10 is a schematic diagram of a radiation pattern of the series-connected antenna structure according to the third embodiment of the present disclosure.
Figure 11:
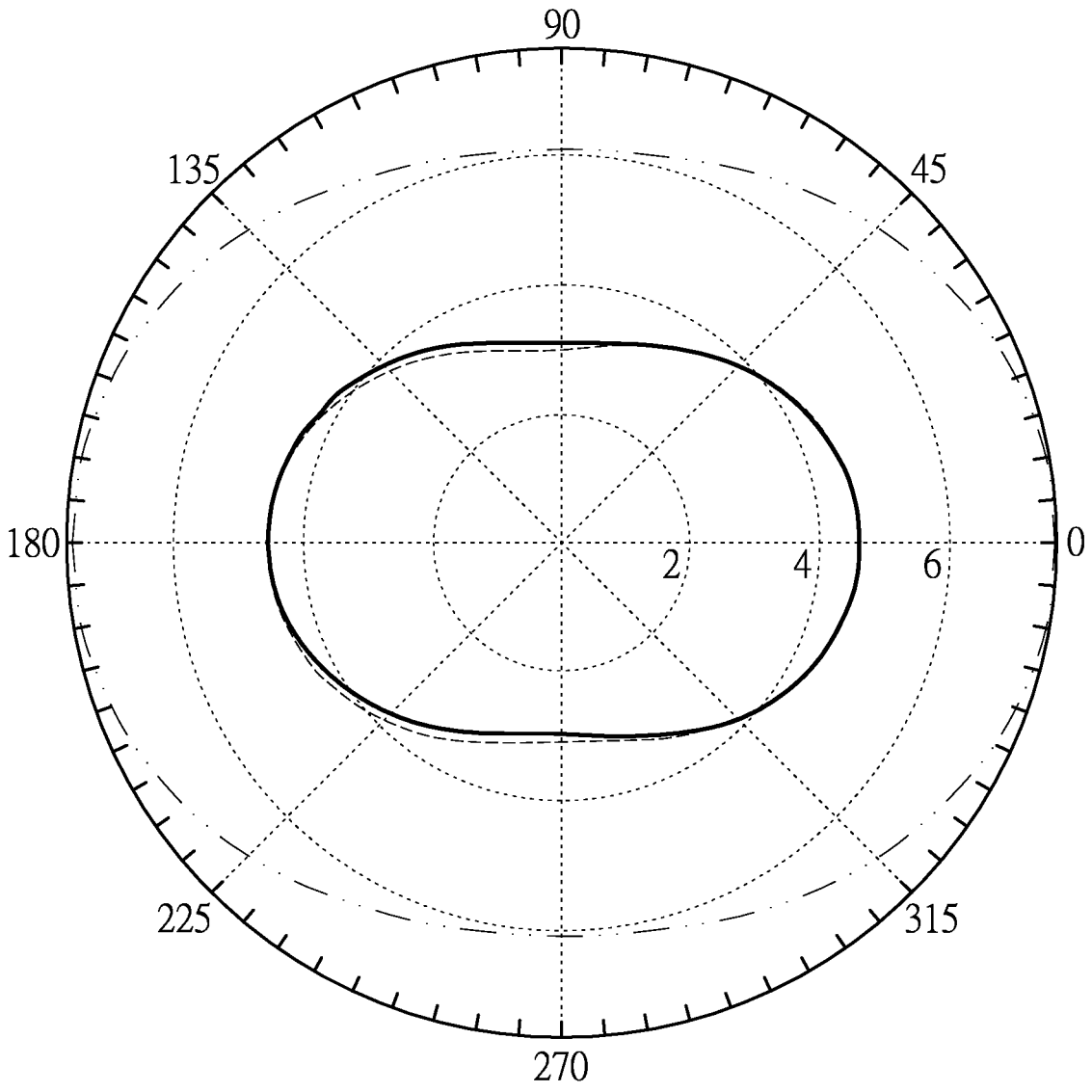
FIG. 11 is a schematic diagram of the radiation pattern of the series-connected antenna structure in an H-plane according to the third embodiment of the present disclosure.
Figure 12:
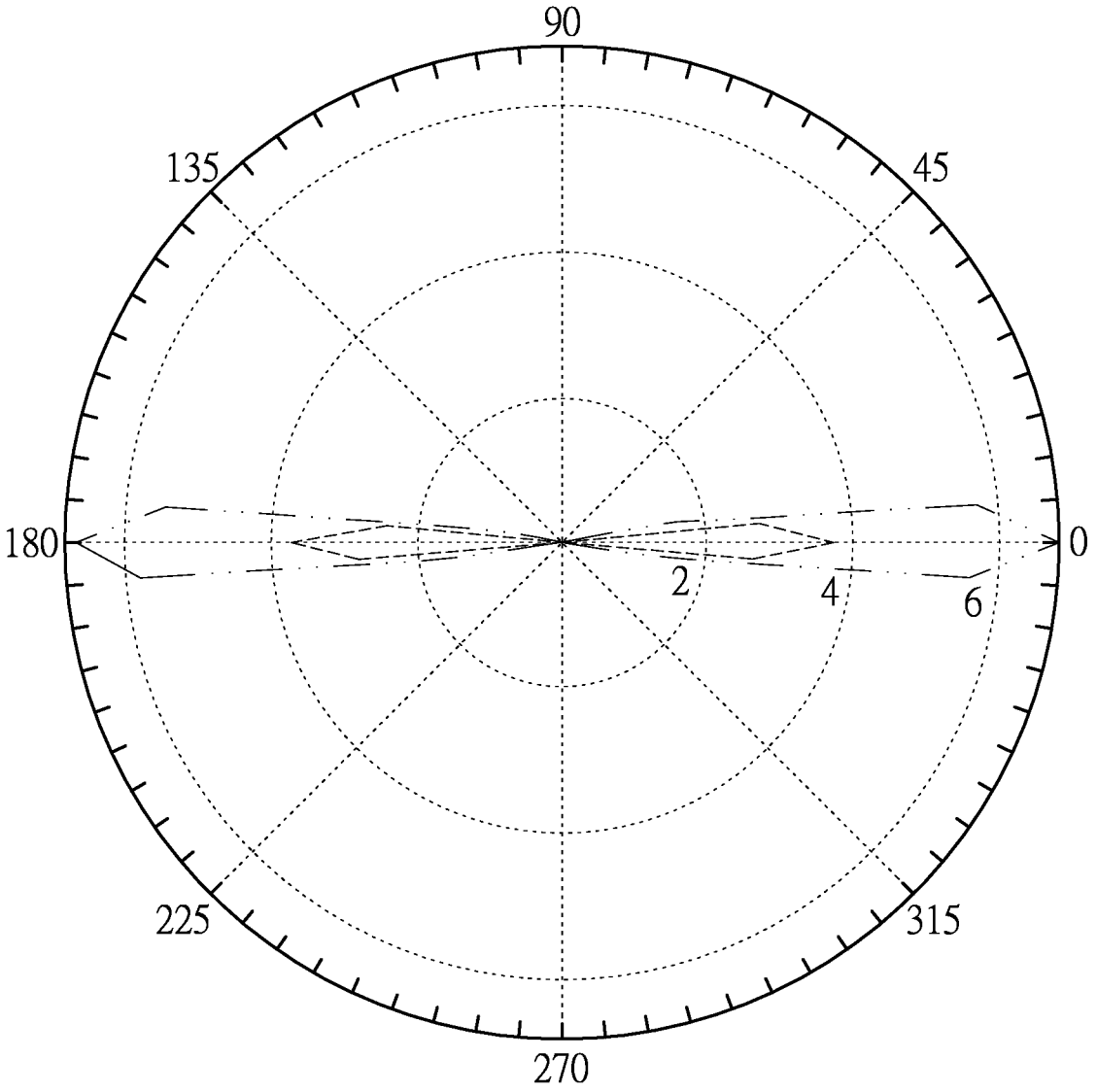
FIG. 12 is a schematic diagram of the radiation pattern of the series-connected antenna structure in an E-plane according to the third embodiment of the present disclosure.

Specifically, by taking the series-connected antenna structure 100A' as an example (referring to FIG. 10 to FIG. 12), a radiation pattern in FIG. 10 is generated by the series-connected antenna structure 100A'. FIG. 11 is a schematic diagram of the radiation pattern of the series-connected antenna structure 100A' in an H-plane, and FIG. 12 is a schematic diagram of the radiation pattern of the series-connected antenna structure 100A' in an E-plane. It is obvious from FIG. 10 to FIG. 12 that, through the above structure, the series-connected antenna structure 100A' enables maximum value of a high frequency and a low frequency of the radiation pattern to be located on a horizontal plane after the two first antennas 130 and the first auxiliary antennas 170 that are disposed on the first board 111 and the two second antennas 150 and the second auxiliary antennas 180 that are disposed on the second board 112 influence each other.

Fourth Embodiment

Figure 13:
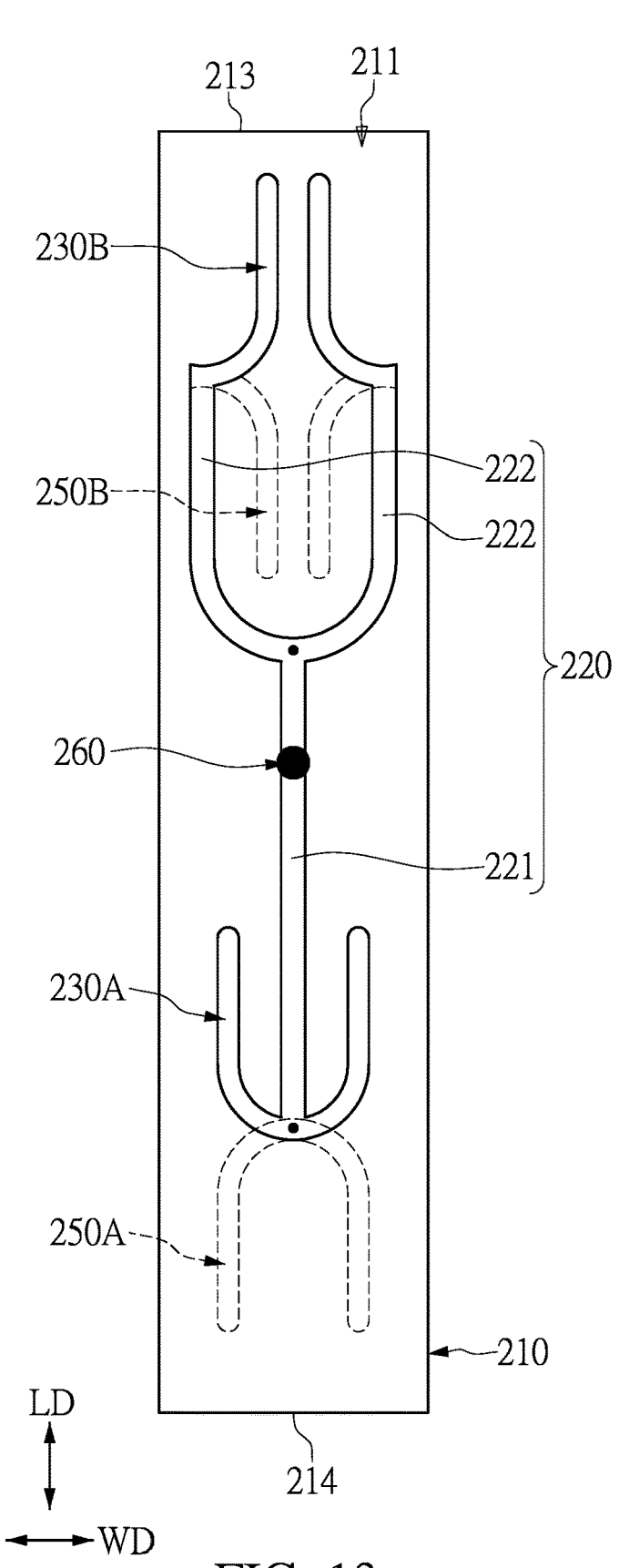
FIG. 13 is a schematic top view of the series-connected antenna structure according to a fourth embodiment of the present disclosure.
Figure 14:
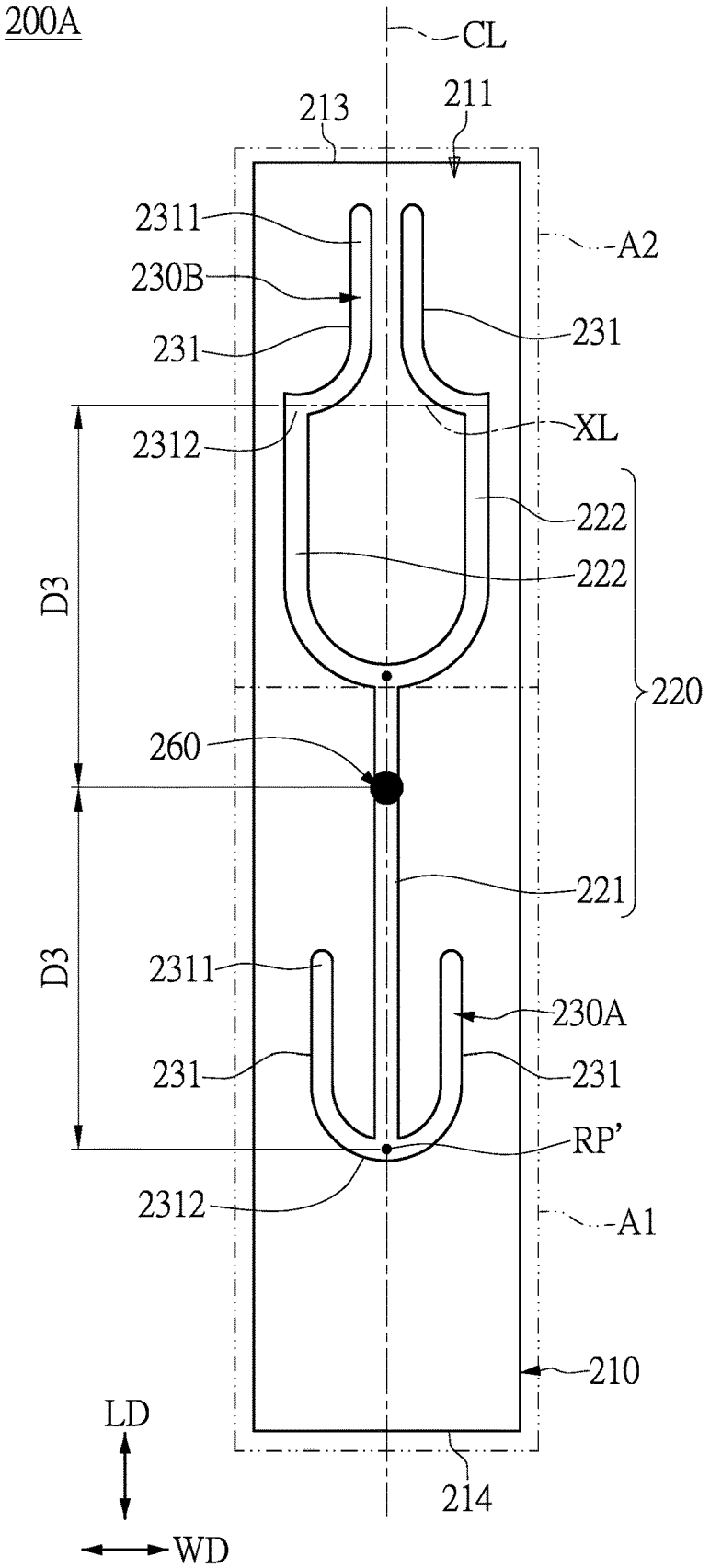
FIG. 14 is a schematic top view of facing the first surface of the series-connected antenna structure according to the fourth embodiment of the present disclosure.
Figure 15:
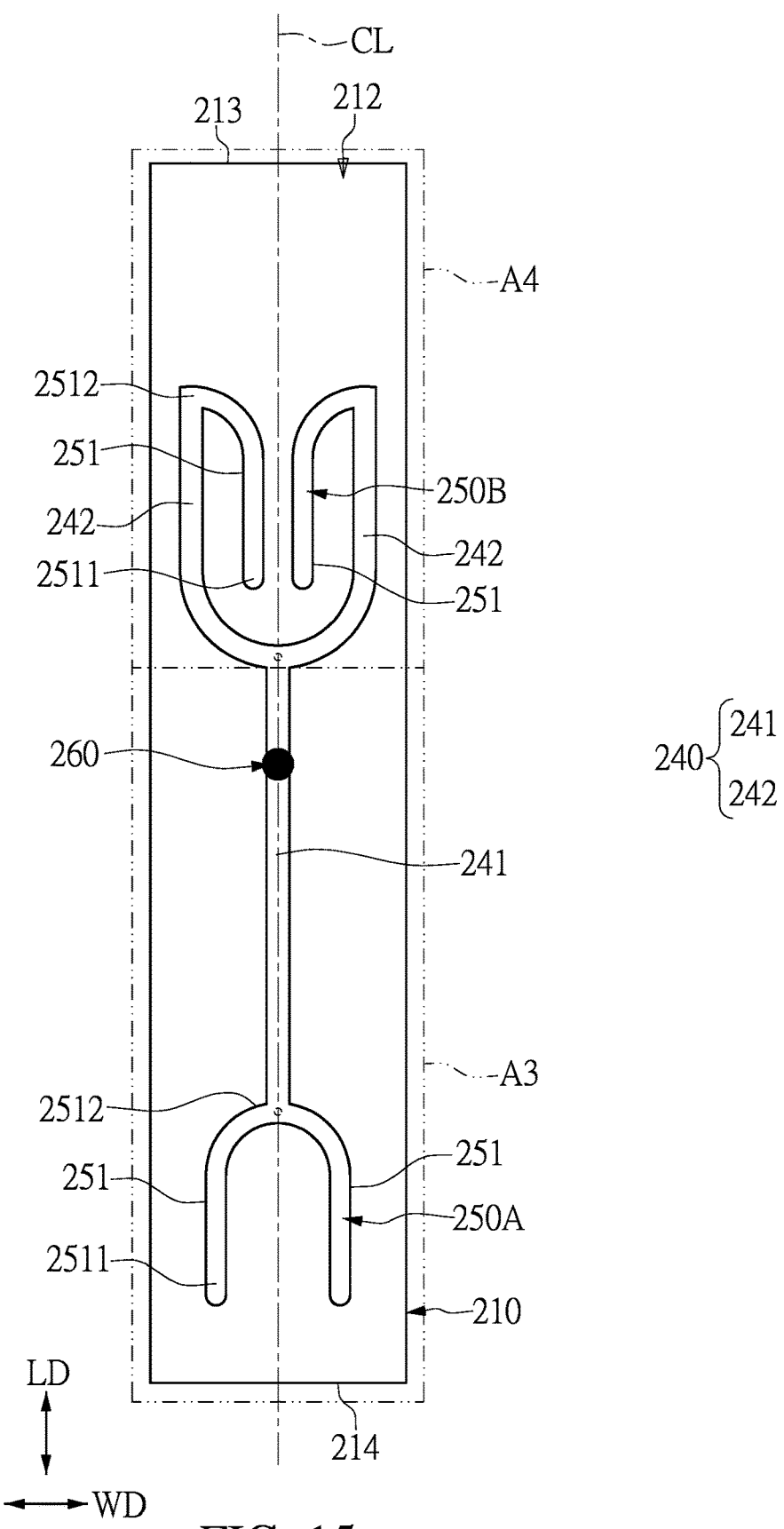
FIG. 15 is a schematic top view of facing the second surface of the series-connected antenna structure according to the fourth embodiment of the present disclosure.

Referring to FIG. 13 to FIG. 15, a fourth embodiment of the present disclosure provides a series-connected antenna structure 200A that is similar to the series-connected antenna structure 100A of the first embodiment, and the similarities therebetween will not be repeated herein. The difference between the series-connected antenna structure 200A of the present embodiment and the first embodiment is described as below:

In the present embodiment, the first connecting line 220 includes a first main section 221 and two first subordinate sections 222 that are connected to the first main section 221. The first main section 221 is arranged on one of two sides of the first surface 211 (i.e., a side of the first surface 211 close to the second end 214), and the two first subordinate sections 222 are arranged on another one of the two sides of the first surface 211 (i.e., a side of the first surface 211 close to the first end 213) and are spaced apart from each other. The first connecting line 220 is substantially in a Y-shape.

In addition, the second connecting line 240 is the same as the first connecting line 220. In other words, the second connecting line 240 is also substantially in a Y-shape, and includes a second main section 241 and two second subordinate sections 242 that are connected to second main section 241. The second main section 241 is arranged on one of two sides of the second surface 212, and the two second subordinate sections 242 are arranged on another one of the two sides of the second surface 212 and are spaced apart from each other. It is worth noting that a region defined by orthogonally projecting the two second subordinate sections 242 and the second main section 241 (i.e., the second connecting line 240) toward the first surface 211 is overlapped with the two first subordinate sections 222 and the first main section 221 (i.e., the first connecting line 220).

In other words, referring to FIG. 14 and FIG. 15, the first surface 211 is divided into opposite sides by an electrical coupling point between the two first subordinate sections 222 and the first main section 221, and has a first area A1 and a second area A2 that are respectively located on the opposite sides of the first surface 211. The second surface 212 is divided into opposite sides by an electrical coupling point between the two second subordinate sections 242 and the second main section 241, and has a third area A3 and a fourth area A4 that are respectively located on the opposite sides of the second surface 212. The first area A1 corresponds in position to the third area A3, and the second area A2 corresponds in position to the fourth area A4. The first main section 221 is located in the first area A1, the two first subordinate sections 222 are located in the second area A2, the second main section 241 is located in the third area A3, and the two second subordinate sections 242 are located in the fourth area A4.

Based on the changes of the first connecting line 220 and the second connecting line 240 in the present embodiment, two first antennas 230A, 230B and two second antennas 250A, 250B are also different from those of the first embodiment. Specifically, the two first antennas 230A, 230B are respectively located in the first area A1 and the second area A2. Two first sub-antennas 231 of the first antenna 230A located in the first area A1 are electrically coupled to the first main section 221 by first connection ends 2312 thereof, and jointly form a first symmetrical shape (i.e., a U-shape). The two first sub-antennas 231 of the first antenna 230B located in the second area A2 are respectively and electrically coupled to the two first subordinate sections 222 by the first connection ends 2312 thereof, and jointly form a second symmetrical shape.

In other words, the two first antennas 230A, 230B in the present embodiment respectively have two different symmetrical shapes (i.e., the first symmetrical shape and the second symmetrical shape), and the center line CL of the first surface 211 is still a line of symmetry common to the two first antennas 230A, 230B. It should be noted that two first free ends 2311 of each of the two first antennas 230A, 230B face the first end 213 in the present embodiment (as shown in FIG. 14).

Next, referring to FIG. 15, the two second antennas 250A, 250B are respectively located in the third area A3 and the fourth area A4. Two second sub-antennas 251 of the second antenna 250A located in the third area A3 are electrically coupled to the second main section 241 by second connection ends 2512 thereof, and jointly form a first symmetrical shape. The two second sub-antennas 251 of the second antenna 250B located in the fourth area A4 are respectively and electrically coupled to the two second subordinate sections 242 by the second connection ends 2512 thereof, and jointly form a second symmetrical shape.

Referring to FIG. 13 to FIG. 15, it should be noted that a shape of a region defined by orthogonally projecting the second antenna 250A (which is the first symmetrical shape) located in the third area A3 toward the first surface 211 and a shape of the first antenna 230A (which is the first symmetrical shape) located in the first area A1 have a mirror image relationship. A shape of a region defined by orthogonally projecting the second antenna 250B (which is the second symmetrical shape) located in the fourth area A4 toward the first surface 211 and a shape of the first antenna 230B (is the second symmetrical shape) located in the second area A2 have a mirror image relationship. Naturally, the mirror image relationship between the two first antennas 230A, 230B and the two second antennas 250A, 250B in the present embodiment can also be understood as the same as a two-fold rotational symmetry relationship shown between the two first antennas 130 and the two second antennas 150 in the first embodiment.

In addition, the two free ends 2511 of each of the two second antennas 250A, 250B in the present embodiment face the second end 214 (as shown in FIG. 15). In other words, the two second antennas 250A, 250B are opposite to the two first antennas 230A, 230B in terms of direction.

Moreover, a position of a load point 260 of the present embodiment is roughly similar to the load point 160 of the first embodiment. Specifically, referring to FIG. 14, an electrical coupling point between the first main section 221 and two of the first connection ends 2312 of any one of the two first antennas 230A, 230B is defined as a reference position RP', and two electrical coupling points between the two first subordinate sections 222 and two of the first connection ends 2312 of any one of the two first antennas 230A, 230B jointly have a reference line XL. A ratio of a third shortest distance D3 between the load point 260 and the reference line XL to a third shortest distance D3 between the load point 260 and the reference position RP' is 1:1. A shortest distance from the reference line XL to the reference position RP' (that is, a total of the third shortest distances D3) is also 0.5 to 1.5 times a wavelength corresponding to the center frequency of the transmission frequency band, but the present disclosure is not limited thereto. Naturally, in another embodiment of the present disclosure that is not shown, the load point 260 may also be directly and electrically coupled to an end of the first connecting line 220 and an end of the second connecting line 240.

Through the above structure, the series-connected antenna structure 200A not only has the advantages of the first embodiment but also reduces a difference between a maximum value and a minimum value of the radiation pattern on the horizontal plane to be within about 0.5 dBi so that a final radiation pattern FTE of the series-connected antenna structure 200A may approach a circle shape on the H-plane (that is, increasing the degree of roundness).

Fifth Embodiment

Figure 16:
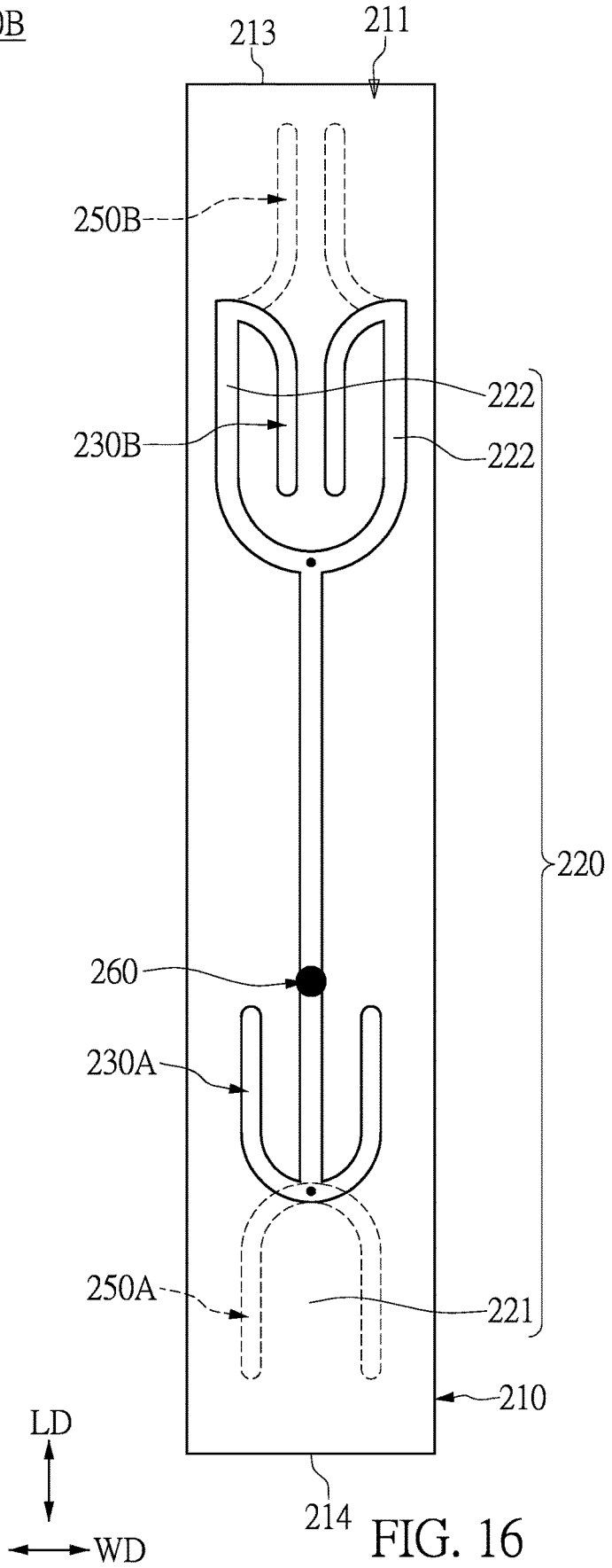
FIG. 16 is a schematic top view of the series-connected antenna structure according to a fifth embodiment of the present disclosure.
Figure 17:
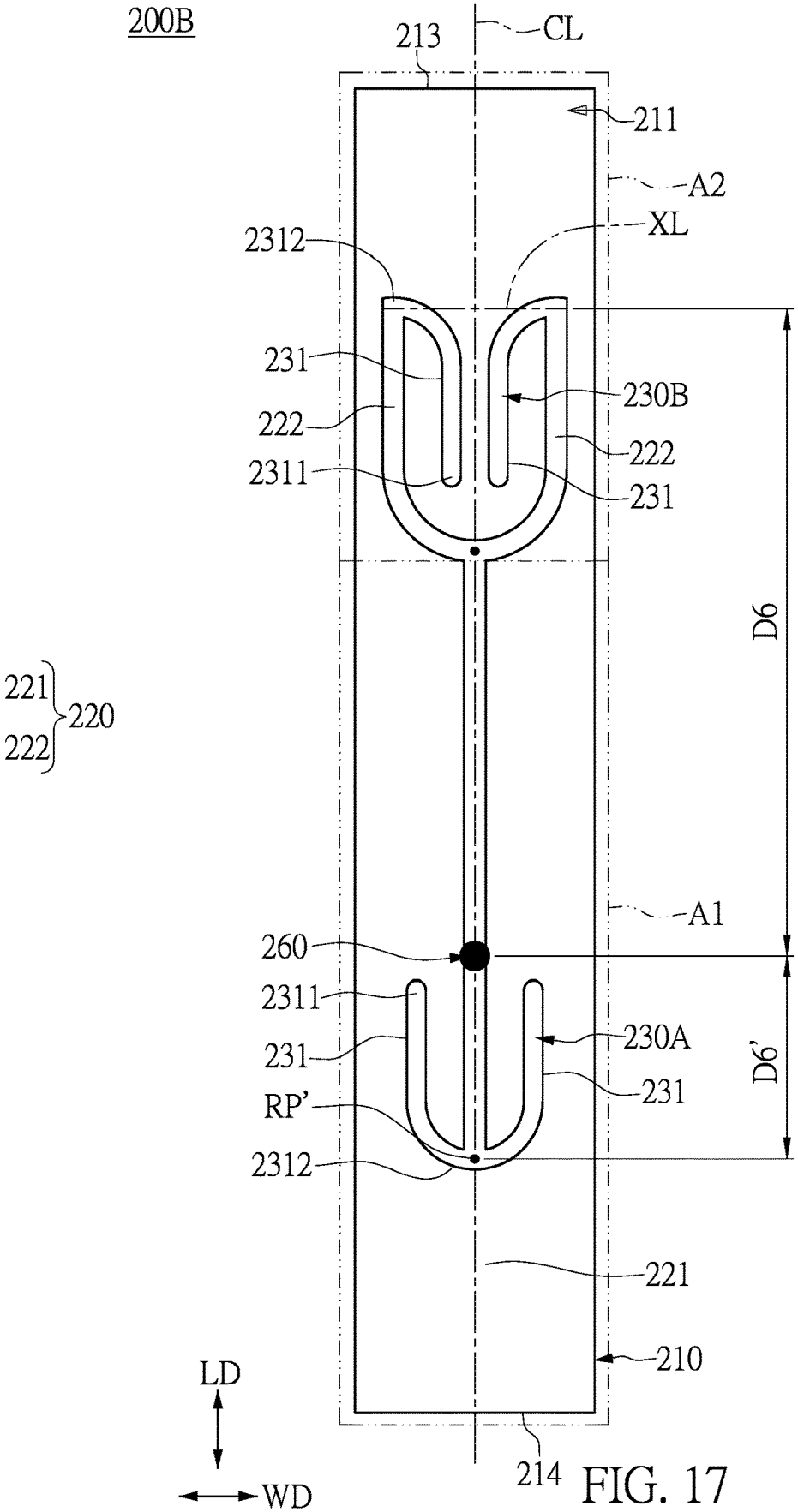
FIG. 17 is a schematic top view of facing the first surface of the series-connected antenna structure according to the fifth embodiment of the present disclosure.
Figure 18:
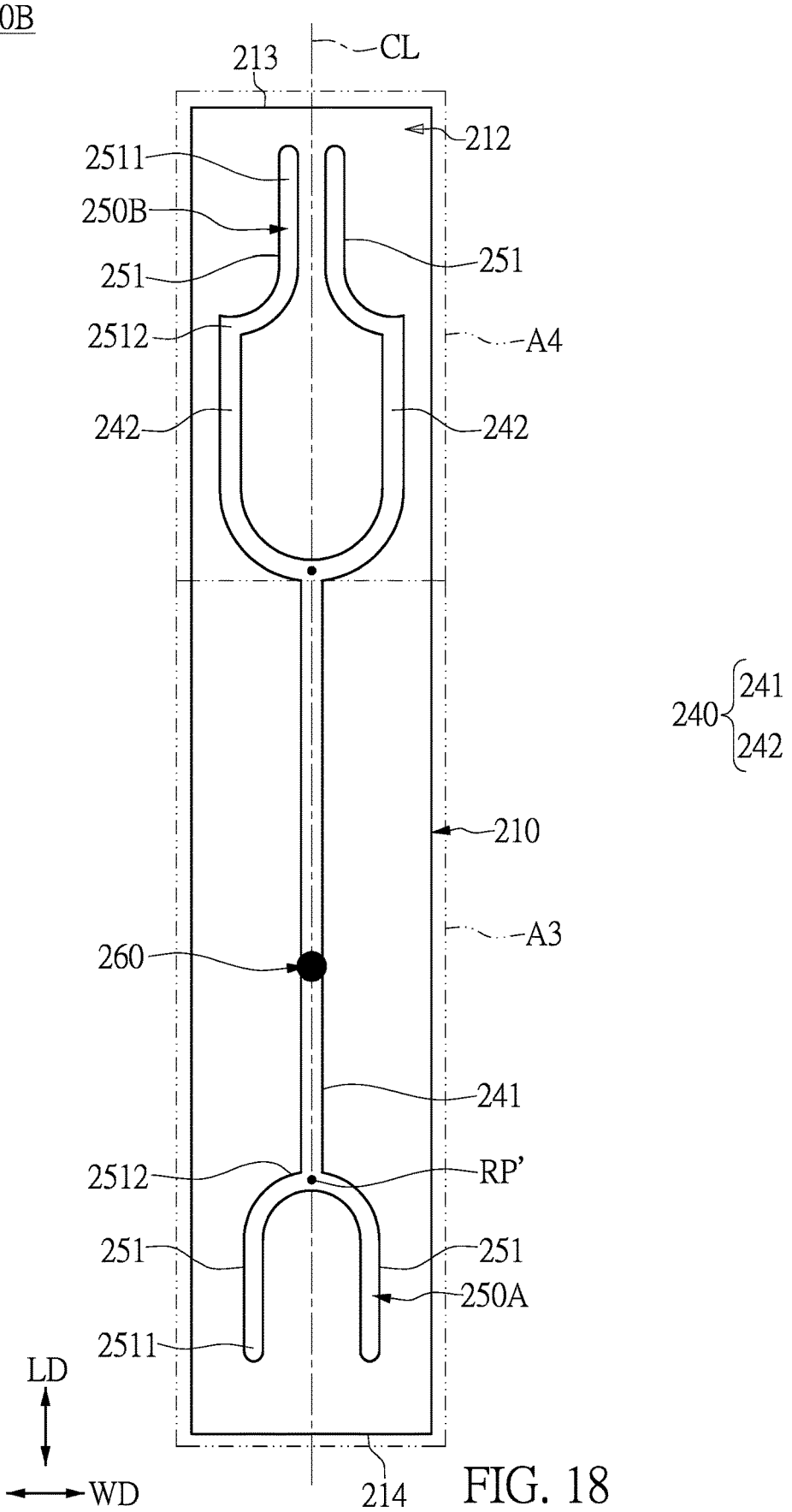
FIG. 18 is a schematic top view of facing the second surface of the series-connected antenna structure according to the fifth embodiment of the present disclosure.

Referring to FIG. 16 to FIG. 18, a fifth embodiment of the present disclosure provides a series-connected antenna structure 200B that is similar to the series-connected antenna structure 200A of the fourth embodiment, and the similarities therebetween will not be repeated herein. The difference between the series-connected antenna structure 200B of the present embodiment and the fourth embodiment mainly lies in that the two first antennas 230A, 230B do not face the same direction, and the two second antennas 250A, 250B do not face the same direction.

Specifically, the two first free ends 2311 of the first antenna 230B in the second symmetrical shape and the two second free ends 2511 of the second antenna 250A in the first symmetrical shape face the second end 214, and the two second free ends 2511 of the second antenna 250B in the second symmetrical shape and the two first free ends 2311 of the first antenna 230A in the first symmetrical shape face the first end 213.

In other words, in the present embodiment, the two first antennas 230A, and 230B face each other, and the two second antennas 250A, 250B face away from each other. A region defined by orthogonally projecting the second antenna 250A toward the first surface 211 and the first antenna 230A jointly have a two-fold rotational symmetry relative to a corresponding the reference position RP', and a region defined by orthogonally projecting the second antenna 250B toward the first surface 211 and the first antenna 230B jointly have a two-fold rotational symmetry relative to a corresponding the reference line XL.

In other words, referring to FIG. 17, the present embodiment is based on the fourth embodiment and further includes the features of the second embodiment. Therefore, a ratio of a first shortest distance D6 between the load point 260 and the reference line XL to a second shortest distance D6' between the load point 260 and the reference position RP' is the same as that in the second embodiment, i.e., being 1:3.

Sixth Embodiment

Figure 19:
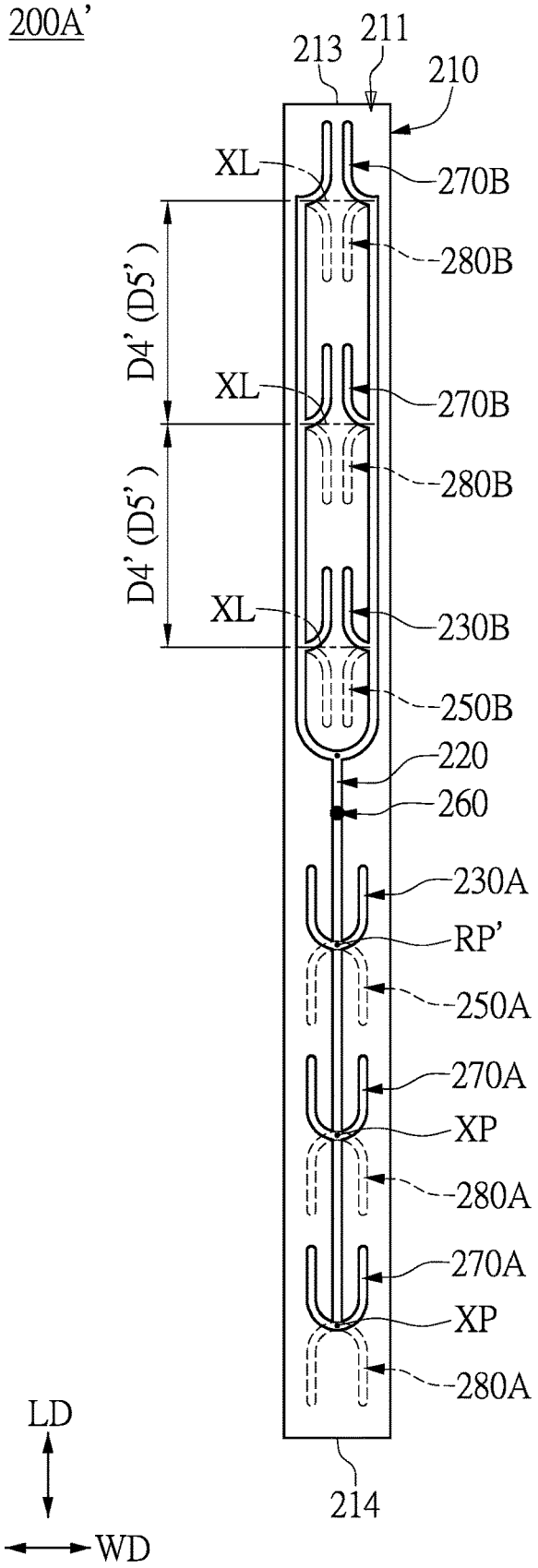
FIG. 19 is a schematic top view of the series-connected antenna structure according to a sixth embodiment of the present disclosure.
Figure 21:
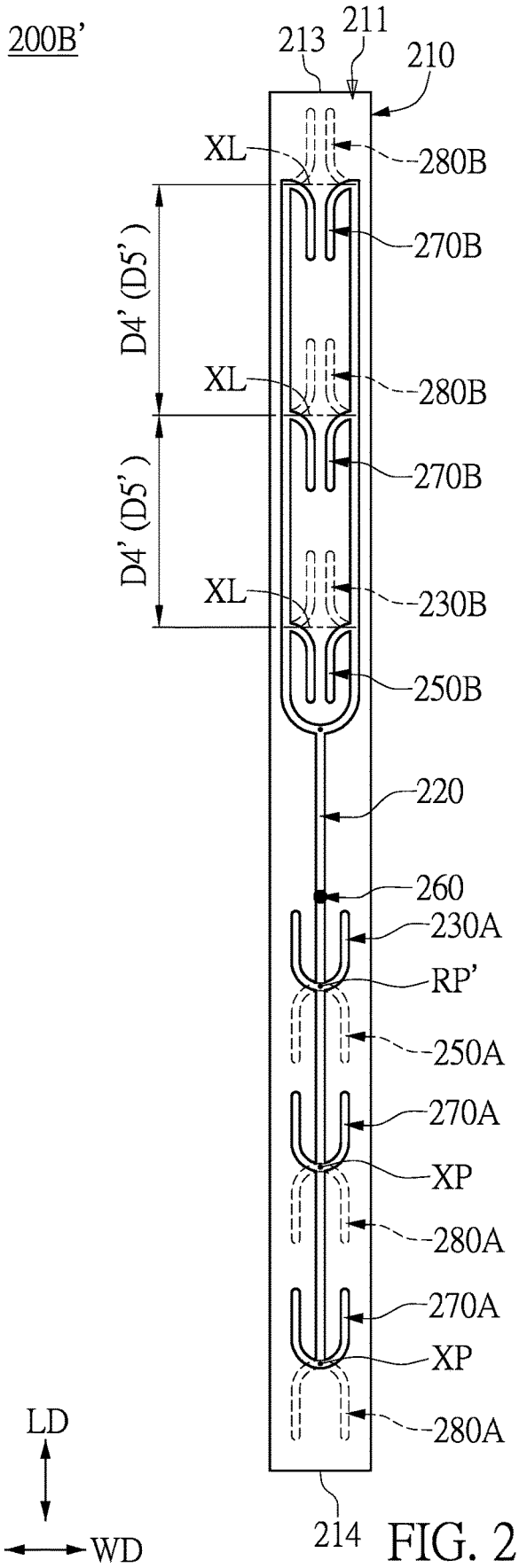
FIG. 21 is a schematic top view of another configuration of the series-connected antenna structure according to the sixth embodiment of the present disclosure.

Referring to FIG. 19 to FIG. 27, a sixth embodiment of the present disclosure provides series-connected antenna structures 200A', 200B' that are similar to the series-connected antenna structures 200A, 200B of the fourth embodiment and the fifth embodiment, and the similarities therebetween will not be repeated herein. The difference between the series-connected antenna structures 200A', 200B' of the present embodiment and those of the fourth and fifth embodiments is described as below:

Referring to FIG. 19 and FIG. 21, each of the series-connected antenna structures 200A', 200B' in the present embodiment further include a plurality of first auxiliary antennas 270A, 270B and a plurality of second auxiliary antennas 280A, 280B. Specifically, the first auxiliary antennas 270A, 270B in the present embodiment are equally disposed on the first surface 211 (that is, quantities of the first auxiliary antennas respectively located on two sides of the load point 260 are equal to each other).

Figure 20:
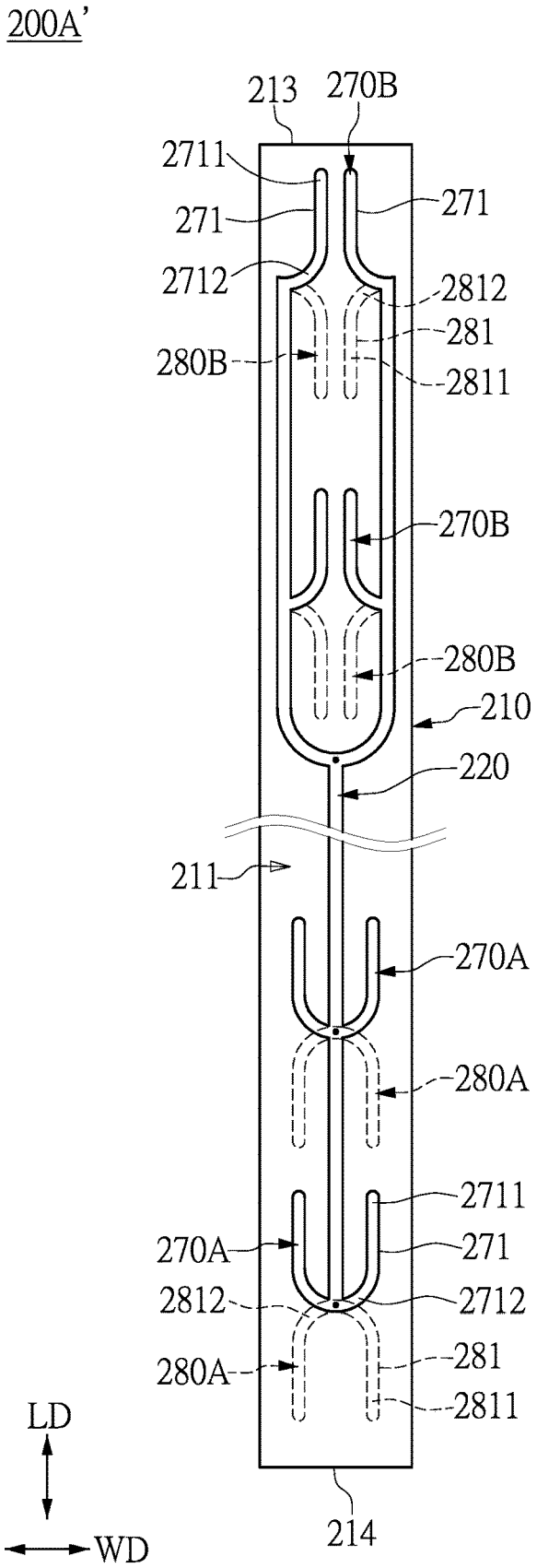
FIG. 20 is a schematic top view of a part of the series-connected antenna structure according to the sixth embodiment of the present disclosure.
Figure 22:
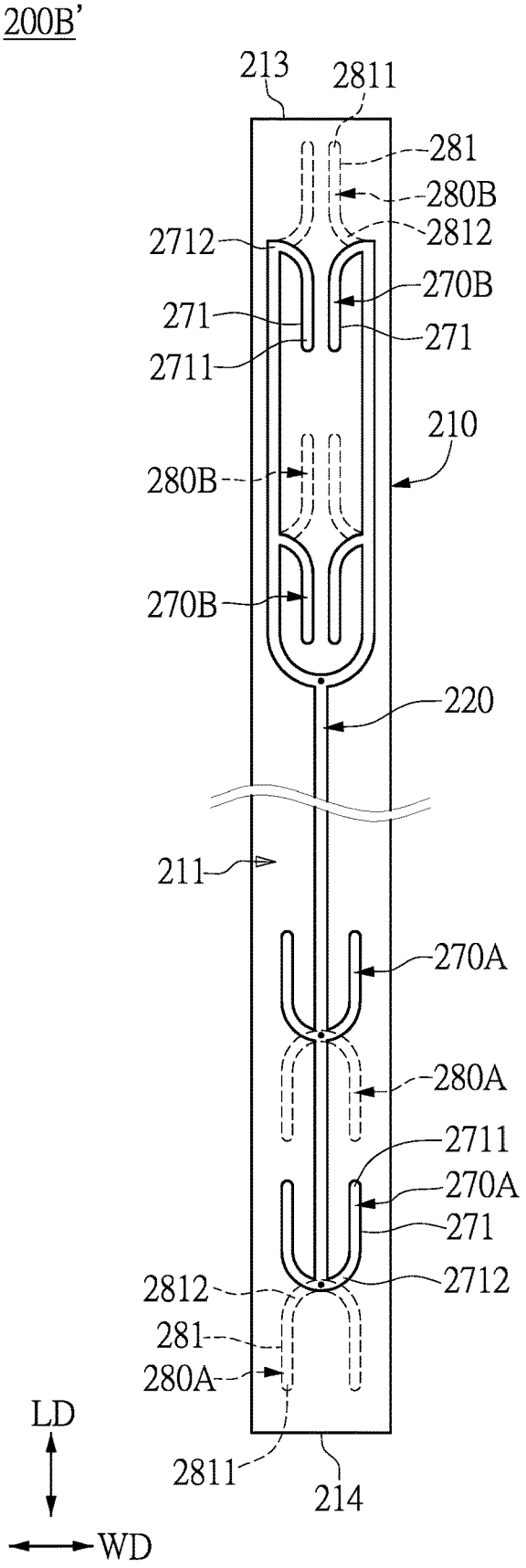
FIG. 22 is a schematic top view of a part of the another configuration of the series-connected antenna structure according to the sixth embodiment of the present disclosure.

Referring to FIG. 20 and FIG. 22, each of the first auxiliary antennas 270A, 270B has two first sub-auxiliary antennas 271 each having one of a plurality of first free ends 2711 and one of a plurality of first connection ends 2712 that are opposite to each other. The two first sub-auxiliary antennas 271 of each of the first auxiliary antennas 270A disposed on one of two sides of the first surface 211 that has the first main section 221 are electrically coupled to the first main section 221 by the first connection ends 2712 thereof, and jointly form the first symmetrical shape (i.e., a U shape). The two first sub-auxiliary antennas 271 of each of the first auxiliary antennas 270B disposed on another one of the two sides of the first surface 211 that has the two first subordinate sections 222 are respectively and electrically coupled to the two first subordinate sections 222 by the first connection ends 2712 thereof, and jointly form the second symmetrical shape.

Furthermore, the two first free ends 2711 of each of the first auxiliary antennas 270A and the two first free ends 2311 of the first antenna 230A face the same direction, and the two first free ends 2711 of each of the first auxiliary antennas 270B and the two first free ends 2311 of the first antenna 230B face the same direction. In other words, on any one of the two sides of the load point 260, each of the first auxiliary antennas is equivalent to the first antenna that corresponds in position thereto in terms of direction and shape.

Moreover, quantities of the second auxiliary antennas 280A, 280B are equal to quantities of the first auxiliary antennas 270A, 270B. The second auxiliary antennas 280A, 280B are equally disposed on the second surface 212 (that is, the quantities of the second auxiliary antennas 280A, 280B respectively located on two sides of the load point 260 are equal to each other), and the second auxiliary antennas 280A, 280B correspond in position to the first auxiliary antennas 270A, 270B.

Each of the second auxiliary antennas 280A, 280B has two second sub-auxiliary antennas 281 each having one of a plurality of second free ends 2811 and one of a plurality of second connection ends 2812 that are opposite to each other. The two second sub-auxiliary antennas 281 of each of the second auxiliary antennas 280A disposed on one of two sides of the second surface 212 that has the second main section 241 are electrically coupled to the second main section 241 by the second connection ends 2812 thereof, and jointly form the first symmetrical shape (i.e., a U shape). The two second sub-auxiliary antennas 281 of each of the second auxiliary antennas 280B disposed on another one of the two sides of the second surface 212 that has the two second subordinate sections 242 are respectively and electrically coupled to the two second subordinate sections 242 by the second connection ends 2812 thereof, and jointly form the second symmetrical shape.

Furthermore, the two second free ends 2811 of each of the second auxiliary antennas 280A located on one of two sides of the load point 260 and the two second free ends 2511 of the second antenna 250A face the same direction. Moreover, the two second free ends 2811 of each of the second auxiliary antennas 280B located on another one of the two sides of the load point 260 and the two second free ends 2511 of the second antenna 250B face the same direction.

It can be seen that, in terms of arrangement direction and arrangement method, any one of the first auxiliary antennas 270A, 270B is disposed on the insulating substrate 210 in a manner substantially the same as that of the first antenna that is located on the same side (or same area), and any one of the second auxiliary antennas 280A, 280B is disposed on the insulating substrate 210 in a manner substantially the same as that of the second antenna that is located on the same side (or same area).

Referring to FIG. 20 and FIG. 21, it should be noted that a distance between any two of the first auxiliary antennas adjacent to each other (that is, the distance between two of the reference lines XL adjacent to each other or between two of the auxiliary reference positions XP adjacent to each other) and a distance between any one of the two first antennas and an adjacent one of the first auxiliary antennas (that is, the distance between the reference position RP' and an adjacent one of the reference lines XL) each are defined as a first shortest distance D4', and the first shortest distances D4' are equal to each other. Moreover, a distance between any two of the second auxiliary antennas adjacent to each other and a distance between any one of the two second antennas and an adjacent one of the second auxiliary antennas each are defined as a second shortest distance D5', and the second shortest distances D5' are equal to each other. Each of the first shortest distances D4' and each of the second shortest distances D5' are preferably equal to the wavelength corresponding to the center frequency of the transmission frequency band.

In addition, referring to FIG. 20 and FIG. 22, although a quantity of the first auxiliary antennas and a quantity of the second auxiliary antennas are each an even number (e.g., four), and the first auxiliary antennas and the second auxiliary antennas are equally disposed on the first surface 211 and the second surface 212, the present disclosure is not limited thereto. For example, the quantity of the first auxiliary antennas and the quantity of the second auxiliary antennas may also each be an odd number (e.g., three), and the first auxiliary antennas and the second auxiliary antennas may be unequally disposed on the first surface 211 and the second surface 212.

Compared with the fourth embodiment and the fifth embodiment, the series-connected antenna structures 200A', 200B' of the present embodiment can increase an intensity of the radiation pattern according to user requirements.

Figure 23:
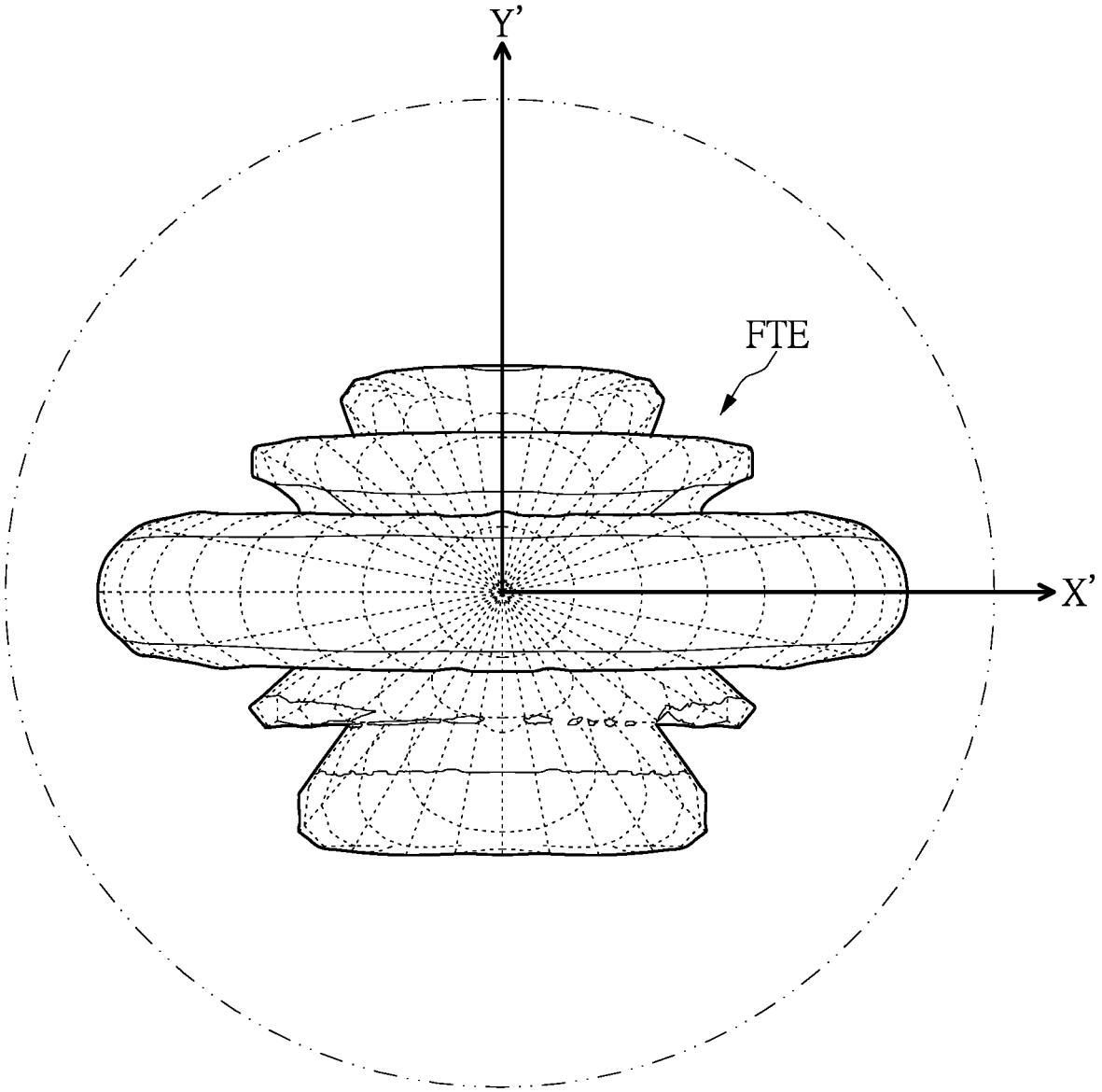
FIG. 23 is a schematic side view of a final radiation pattern of the series-connected antenna structure according to the sixth embodiment of the present disclosure.
Figure 24:
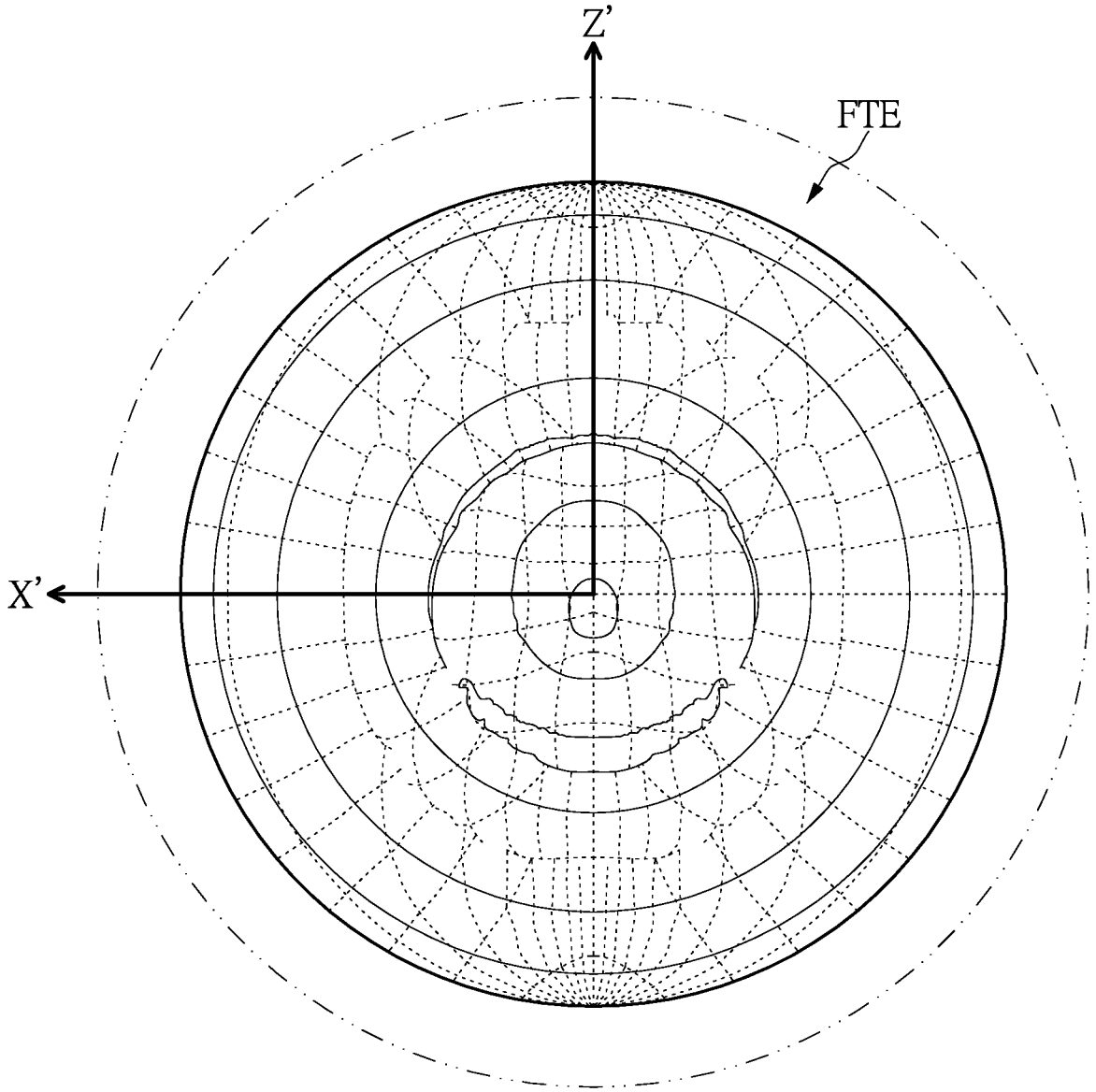
FIG. 24 is a schematic top view of the final radiation pattern of the series-connected antenna structure according to the sixth embodiment of the present disclosure.
Figure 25:
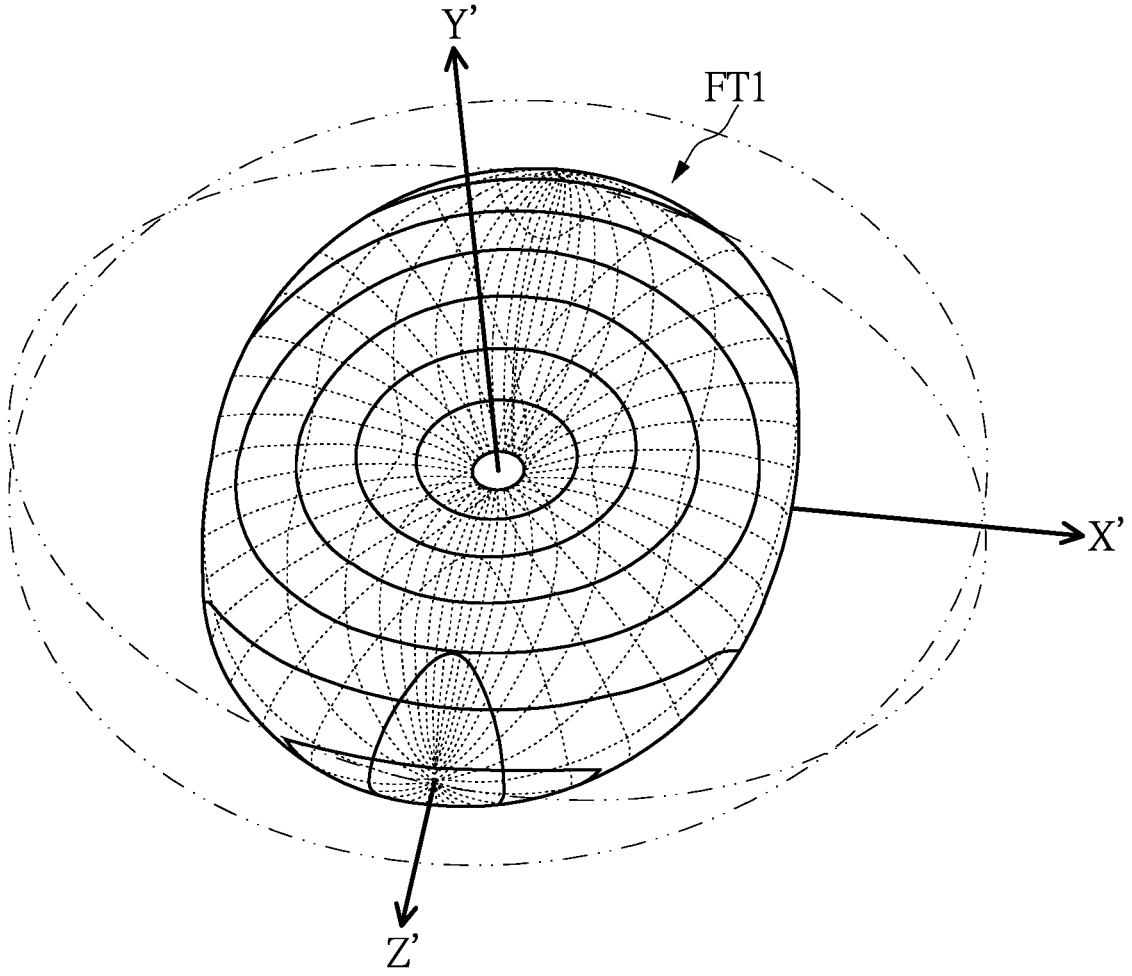
FIG. 25 is a schematic diagram of a first radiation pattern of the series-connected antenna structure according to the sixth embodiment of the present disclosure.
Figure 26:
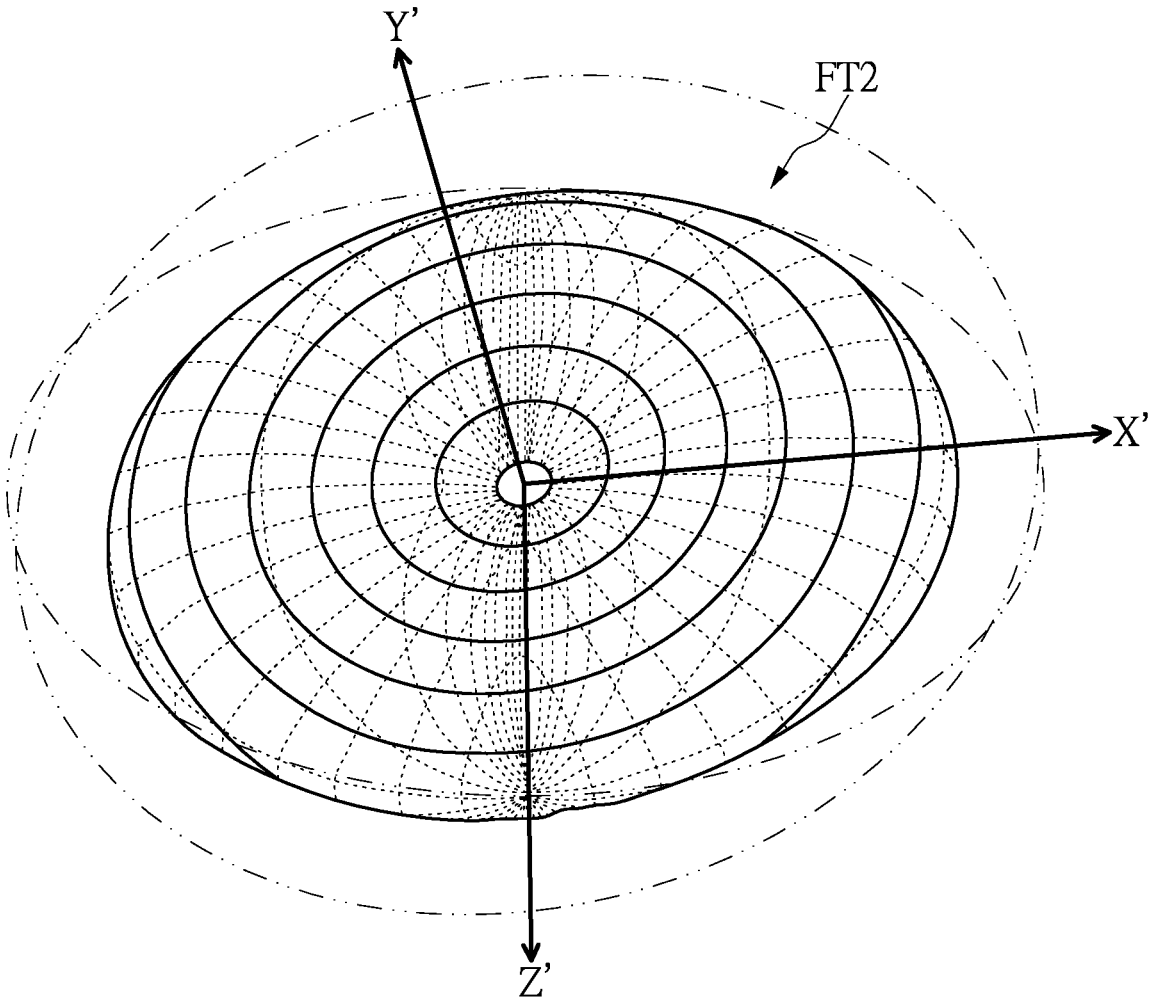
FIG. 26 is a schematic diagram of a second radiation pattern of the series-connected antenna structure according to the sixth embodiment of the present disclosure.

Specifically, by taking the series-connected antenna structure 200A' as an example (referring to FIG. 23 to FIG. 27), a schematic diagram of each of FIG. 23 and FIG. 24 shows a final radiation pattern FTE generated by the series-connected antenna structure 200A'. A first radiation pattern FT1 in FIG. 25 is jointly generated by the first antenna 230A in the first area A1 and the second antenna 250A in the third area A3, and a second radiation pattern FT2 in FIG. 26 is jointly generated by the first antenna 230B in the second area A2 and the second antenna 250B in the fourth area A4. In other words, when the two first antennas 230A, 230B and the two second antennas 250A, 250B are connected in series (that is, the first radiation pattern FT1 and the second radiation pattern FT2 are combined with each other), the series-connected antenna structure 200A' will generate the final radiation pattern FTE, as shown in FIG. 23 and FIG. 24.

Figure 27:
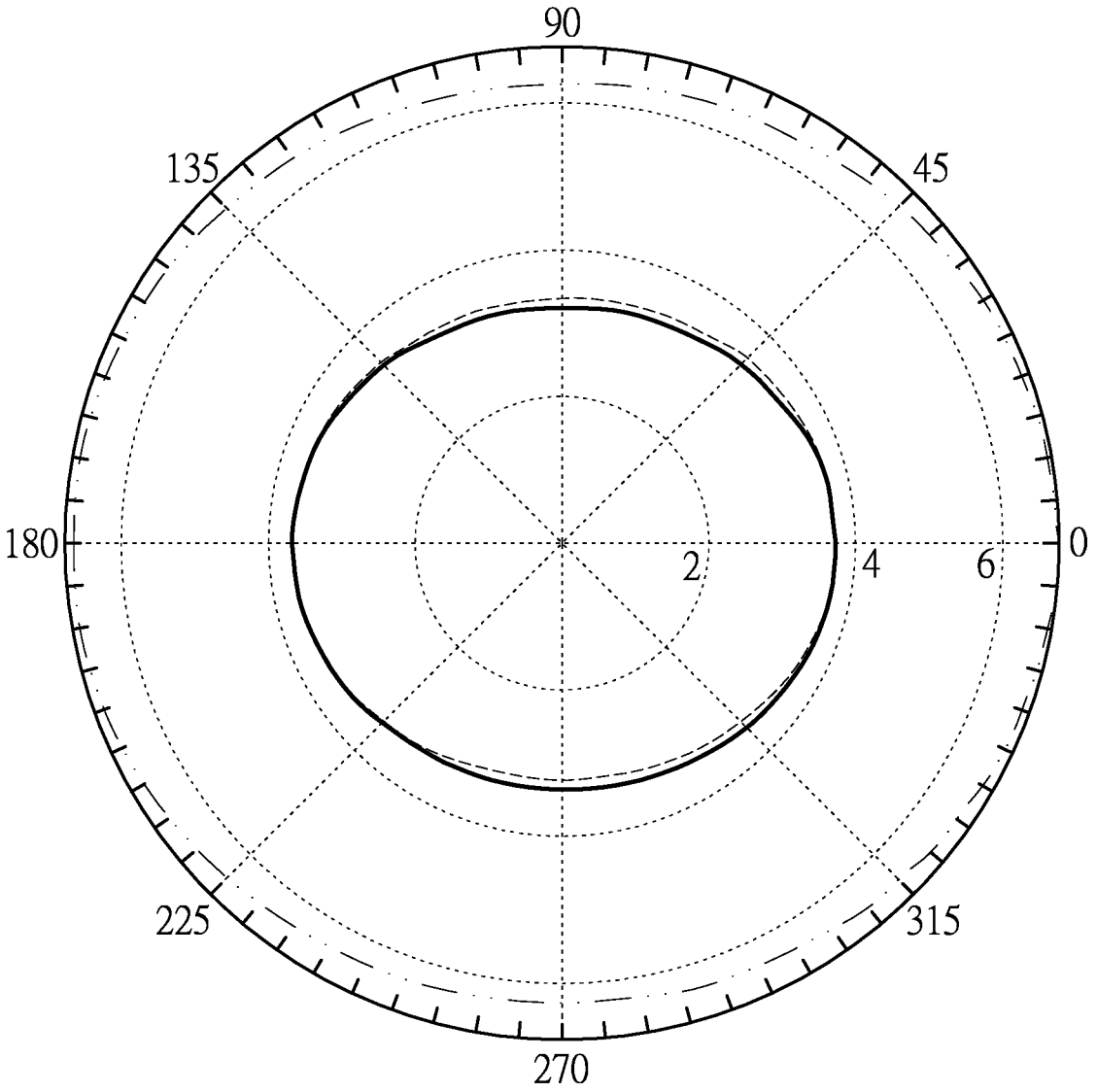
FIG. 27 is a schematic diagram of the final radiation pattern of the series-connected antenna structure in the H-plane according to the sixth embodiment of the present disclosure.

It is obvious from the final radiation FTE in FIG. 23 and FIG. 24 that, after the first radiation pattern FT1 and second radiation pattern FT2 compensate each other, the series-connected antenna structure 200A' not only has the advantages of the first embodiment but also reduces a difference between a maximum value and a minimum value of the radiation pattern on the horizontal plane to be within about 0.5 dBi, so that make a final radiation pattern FTE of the series-connected antenna structure 200A' may approach a circle shape on the H-plane (that is, increasing the degree of roundness), as shown in FIG. 27.

Beneficial Effects of the Embodiments

In conclusion, by virtue of "in one of the two first antennas and one of the two second antennas that correspond in position to each other, the connection end of the two first sub-antennas being electrically coupled to the main section of the first connecting line, and the connection end of the two second sub-antennas being electrically coupled to the main section of the second connecting line" and "in one of the two first antennas and one of the two second antennas that correspond in position to each other, the connection end of the two first sub-antennas being respectively and electrically coupled to the two subordinate sections of the first connecting line, and the connection end of the two second sub-antennas being respectively and electrically coupled to the two subordinate sections of second connecting line", the series-connected antenna structure can improve the degree of roundness.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A series-connected antenna structure, comprising:

an insulating substrate including a first surface and a second surface;

a first connecting line disposed on the first surface and including a first main section and two first subordinate sections that are connected to the first main section, wherein the first main section is arranged on one of two sides of the first surface, and the two first subordinate sections are arranged on another one of the two sides of the first surface;

two first antennas disposed on the first surface and spaced apart from each other, wherein each of the two first antennas has two first sub-antennas each having one of a plurality of first free ends and one of a plurality of first connection ends that are opposite to each other, wherein the two first sub-antennas of one of the two first antennas are electrically coupled to the first main section by the first connection ends thereof, and jointly form a symmetrical shape, and wherein the two first sub-antennas of another one of the two first antennas are respectively and electrically coupled to the two first subordinate sections by the first connection ends thereof, and jointly form a symmetrical shape;

a second connecting line disposed on the second surface and including a second main section and two second subordinate sections that are connected to the second main section, wherein the second main section is arranged on one of two sides of the second surface, and the two second subordinate sections are arranged on another one of the two sides of the second surface;

two second antennas disposed on the second surface and spaced apart from each other, wherein the two second antennas correspond in position to the two first antennas, wherein each of the two second antennas has two second sub-antennas each having one of a plurality of second free ends and one of a plurality of second connection ends that are opposite to each other, and wherein the two second sub-antennas of one of the two second antennas are electrically coupled to the second main section by the second connection ends thereof, and jointly form a symmetrical shape, wherein the two second sub-antennas of another one of the two second antennas are respectively and electrically coupled to the two second subordinate sections by the second connection ends thereof, and jointly form a symmetrical shape, and wherein, in one of the two second antennas and one of the two first antennas that correspond in position to each other, two of the second free ends of the second antenna and two of the first free ends of the first antenna face opposite directions; and a load point disposed on the insulating substrate and electrically coupled to the first connecting line and the second connecting line;

wherein the insulating substrate has a transverse line that crosses the load point and is parallel to a width direction of the insulating substrate, and each of the first connecting line and the second connecting line has an asymmetrical shape relative to the transverse line.

2. The series-connected antenna structure according to claim 1, wherein an electrical coupling point between the first main section and two of the first connection ends of one of the two first antennas is defined as a reference position, and two electrical coupling points between the two second subordinate sections and two of the first connection ends of one of the two first antennas jointly have a reference line; wherein the load point penetrates the insulating substrate and is electrically coupled to the first connecting line and the second connecting line, and a ratio of a shortest distance between the load point and the reference line to a shortest distance between the load point and the reference position is 1:1.

3. The series-connected antenna structure according to claim 2, wherein the series-connected antenna structure is suitable for a transmission frequency band, and a shortest distance between the reference position and the reference line is 0.5 to 1.5 times a wavelength corresponding to a center frequency of the transmission frequency band.

4. The series-connected antenna structure according to claim 1, wherein the first surface has a first area and a second area that are respectively located on opposite sides of the first surface, and the second surface has a third area that corresponds in position to the first area and a fourth area that corresponds in position to the second area; wherein the first main section and one of the two first antennas are located in the first area, and the two first subordinate sections and another one of the two first antennas are located in the second area; wherein the second main section and one of the two second antennas are located in the third area, and the two second subordinate sections and another one of the two second antennas are located in the fourth area; wherein a shape of a region defined by orthogonally projecting one of the two second antennas located in the third area toward the first surface and a shape of one of the two first antennas located in the first area have a mirror image relationship; wherein a shape of a region defined by orthogonally projecting one of the two second antennas located in the fourth area toward the first surface and a shape of one of the two first antennas located in the second area have a mirror image relationship.

5. The series-connected antenna structure according to claim 1, wherein the first surface has a first area and a second area that are respectively located on opposite sides of the first surface, and the second surface has a third area that corresponds in position to the first area and a fourth area that corresponds in position to the second area; wherein the series-connected antenna structure further includes:

a plurality of first auxiliary antennas disposed in the first area and the second area, wherein each of the first auxiliary antennas has two first sub-auxiliary antennas each having one of a plurality of first free ends and one of a plurality of first connection ends that are opposite to each other, wherein the two first sub-auxiliary antennas of each of the first auxiliary antennas located in the first area are electrically coupled to the first main section by the first connection ends thereof, and jointly form a symmetrical shape, and wherein the two first sub-auxiliary antennas of each of the first auxiliary antennas located in the second area are respectively and electrically coupled to the two first subordinate sections by the first connection ends thereof, and jointly form a symmetrical shape; and a plurality of second auxiliary antennas disposed in the third area and the fourth area, wherein each of the second auxiliary antennas has two second sub-auxiliary antennas each having one of a plurality of second free ends and one of a plurality of second connection ends that are opposite to each other, wherein the two second sub-auxiliary antennas of each of the second auxiliary antennas located in the third area are electrically coupled to the second main section by the second connection ends thereof, and jointly form a symmetrical shape, and wherein the two second sub-auxiliary antennas of each of the second auxiliary antennas located in the fourth area are respectively and electrically coupled to the two second subordinate sections by the second connection ends thereof, and jointly form a symmetrical shape.

6. The series-connected antenna structure according to claim 5, wherein, in the first area or the second area, two of the first free ends of each of the first auxiliary antennas and two of the first free ends of the first antenna each face a same direction; wherein, in the third area or the fourth area, two of the second free ends of each of the second auxiliary antennas and two of the second free ends of the second antenna each face a same direction.

7. The series-connected antenna structure according to claim 5, wherein the series-connected antenna structure is suitable for a transmission frequency band; wherein, in the first area or the second area, a distance between the first antenna and an adjacent one of the first auxiliary antennas and a distance between any two of the first auxiliary antennas adjacent to each other are each equal to a wavelength corresponding to a center frequency of the transmission frequency band; wherein, in the third area or the fourth area, a distance between the second antenna and an adjacent one of the second auxiliary antennas and a distance between any two of the second auxiliary antennas adjacent to each other are each equal to the wavelength corresponding to the center frequency of the transmission frequency band.

8. The series-connected antenna structure according to claim 1, wherein a region defined by orthogonally projecting the second connecting line toward the first surface is overlapped with the first connecting line.

9. The series-connected antenna structure according to claim 1, wherein an electrical coupling point between the first main section and two of the first connection ends of one of the two first antennas is defined as a reference position, and two electrical coupling points between the two second subordinate sections and two of the first connection ends of one of the two first antennas jointly have a reference line; wherein a region defined by orthogonally projecting one of the two second antennas electrically coupled to the second main section toward the first surface and one of the two first antennas electrically coupled to the first main section jointly have a two-fold rotational symmetry relative to the reference position; wherein a region defined by orthogonally projecting one of the two second antennas electrically coupled to the two second subordinate sections toward the first surface and one of the two first antennas electrically coupled to the two first subordinate sections jointly have a two-fold rotational symmetry relative to the reference line.

10. The series-connected antenna structure according to claim 1, wherein the first connecting line and the second connecting line are Y-shaped.

* * * * *